United States Patent [19]

Bergman et al.

[11] 4,089,151

[45] May 16, 1978

[54] COIN WRAPPING MACHINE

[75] Inventors: Charles T. Bergman; Robert L. Zwieg, both of Watertown, Wis.

[73] Assignee: Brandt, Inc., Watertown, Wis.

[21] Appl. No.: 795,730

[22] Filed: May 11, 1977

[51] Int. Cl.[2] ..... B65B 57/20; B65B 11/04

[52] U.S. Cl. ..... 53/59 R; 53/212

[58] Field of Search ..... 53/59 R, 212

[56] References Cited

U.S. PATENT DOCUMENTS

| | | | |
|---|---|---|---|
| 3,740,923 | 6/1973 | Itoda et al. | 53/212 |
| 3,950,921 | 4/1976 | Itoda et al. | 53/67 |

*Primary Examiner*—Travis S. McGehee

*Attorney, Agent, or Firm*—Quarles & Brady

[57] ABSTRACT

There is disclosed a coin wrapping machine in which coins of a particular denomination are fed into a hopper from which they are conveyed to a coin count module. The coin count module ejects the coins one at a time, counting them as they are ejected, until a predetermined quantity has been reached. The ejected coins are directed to a stationary, removable coin tube having a central bore whose diameter is sized for the particular denomination of coins. Paper from a roll is fed to the coin tube to surround the stack of coins formed in the tube and a wrapping roller is brought to bear to wrap the paper about the coin stack. Crimper blades are extended into the coin tube and actuated to crimp the ends of the paper tube formed about the coin stack. The completed coin roll is dropped through an opening in a floor upon which the coin tube is seated, and the discharge of a roll is sensed by a door in a discharge chute. The discharge chute also detects the presence of loose coins indicating an improper roll having been formed. The opening in the floor is normally closed by a coin pad, and a coin stool extends through the pad to support the bottom of the stack for positioning of the stack and to vibrate the stack to assist in settling of the coins. The operation is continuous, and is triggered by the discharge of a roll. The machine is set up for a different denomination of coin by adjusting the coin count module, replacing the coin tube with one sized for the new denomination, and replacing the paper roll with paper sized for the new denomination.

21 Claims, 19 Drawing Figures

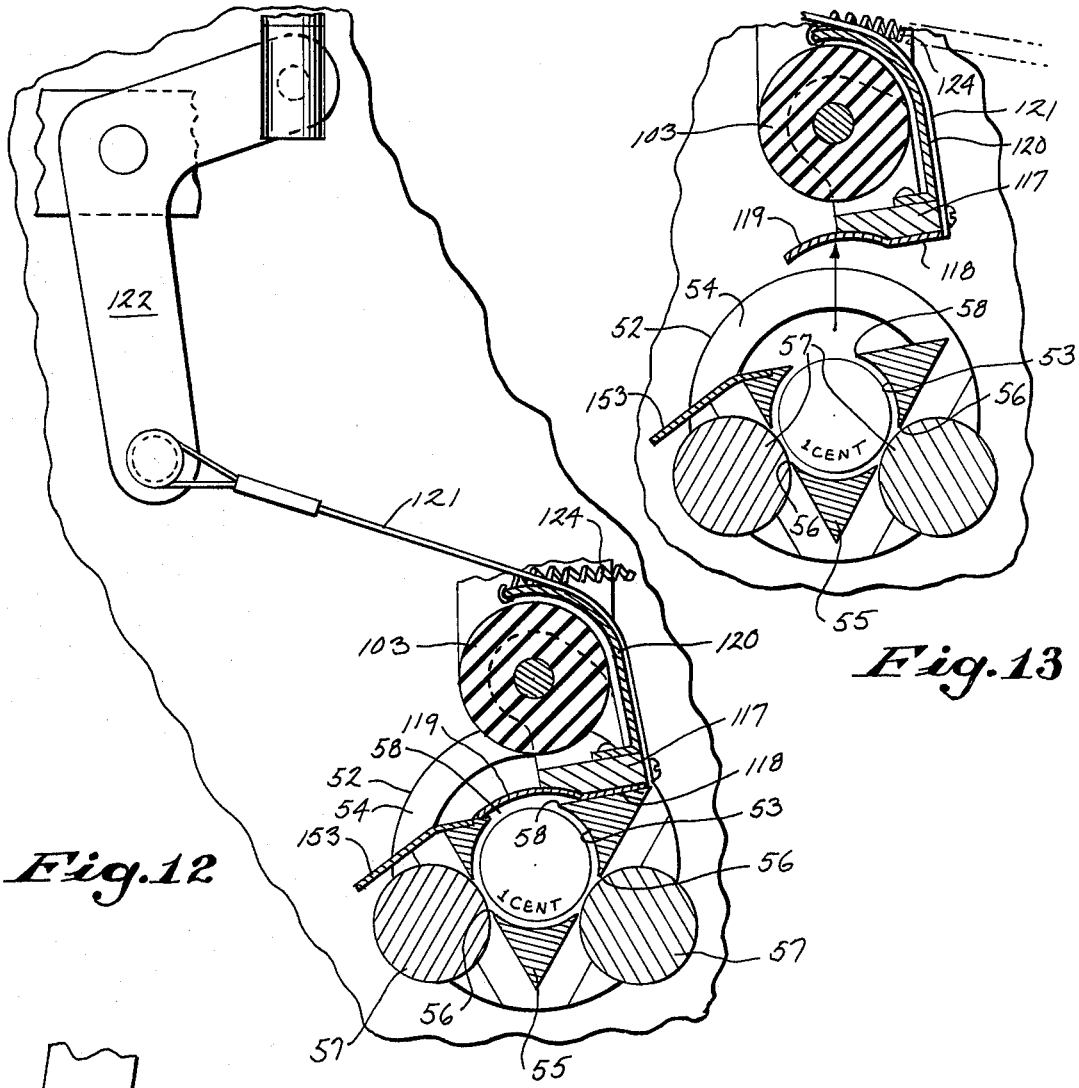
Fig.12
Fig.13
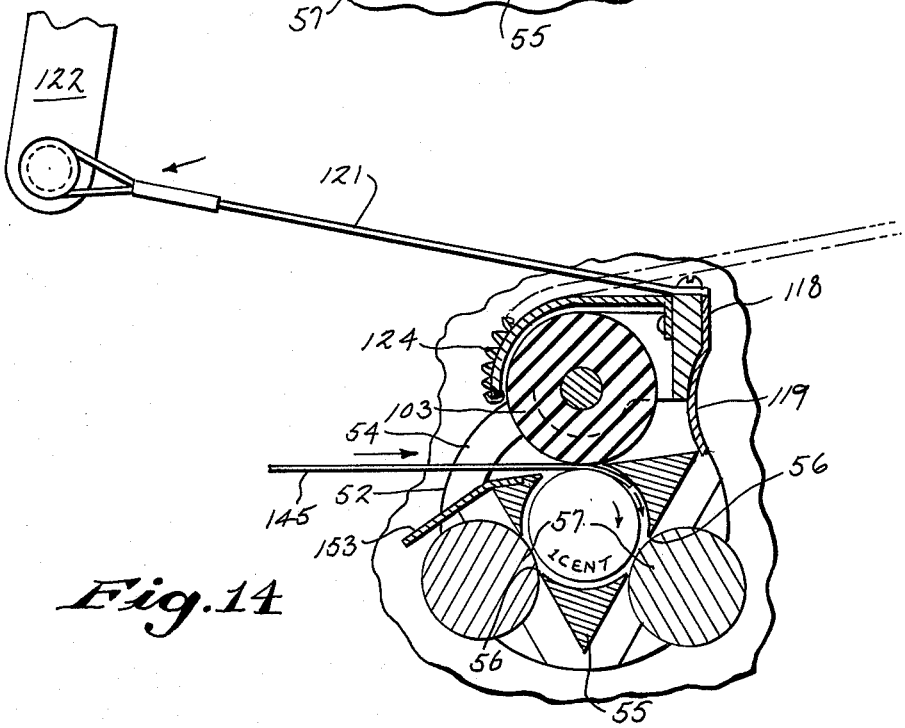
Fig.14

COIN WRAPPING MACHINE

BACKGROUND OF THE INVENTION

This invention relates to the wrapping of coins into rolls, and more particularly to a machine for automatically wrapping coins of various denominations.

Coins are often formed into rolls and wrapped for ease in handling. The rolls vary in size and quantity of coins depending upon the particular denomination. Thus, for example, in U.S. coins, the standard rolls contain fifty coins in the case of pennies and dimes, forty coins in the case of nickles and quarters, and twenty coins in the case of half dollars. The wrappers for coins of different sizes and quantities to form standard rolls also necessarily differ in size.

There are essentially three methods by which standard coin rolls are prepared: manually, semiautomatically, and fully automatically. The manual and semiautomatic methods use preformed coin wrappers and the fully automatic method typically uses a wrapper blank.

In the manual method coins from a precounted stack are manually inserted into a preformed flattened tube which must then be physically closed at each end. The semiautomatic method employs preformed wrappers which have also been closed at one end, usually by crimping, and thus are in the shape of a tube. These preformed wrappers are typically filled by coin counting and packaging machines which accept a supply of coins of a particular denomination and count and eject such coins through a packaging spout into the open end of the wrapper which is then crimped. Such packaging machines are capable of counting out a predetermined quantity of coins and then halting operation until commanded to proceed to dispense another fixed quantity of coins.

In the fully automatic method, machines are provided which will accept a batch of coins of a particular denomination and will automatically form the coins into a stack of predetermined quantity depending upon the denomination. Typically the fully automatic machines will utilize a roll of paper and form wrapper blanks which are wrapped about the stack of coins as needed, rather than using a preformed wrapper or a precut wrapper blank. Examples of the fully automatic machines are found in U.S. Pat. No. 2,635,402 to Jorgensen, issued Apr. 21, 1953, and U.S. Pat. No. 3,382,647 issued May 14, 1968 to Davey et al.

The fully automatic wrapping machines become quite complex in their design and operation because of a need to accommodate the different denominations of coins. One approach to accommodating different denominations within one machine involves the use of a turret having a plurality of parallel bores each of a size to accept a particular denomination of coin. When changing over from operating with one coin denomination to another, the turret is indexed to the proper bores. Examples of machines of this type are U.S. Pat. No. 2,709,880 to Jorgensen, issued June 7, 1955, and U.S. Pat. No. 3,432,983 to Picollo, issued Mar. 18, 1969. This latter patent utilizes a turret having two pairs of bores for each denomination of coins and which is also indexed during the wrapping procedure between a coin stacking station and a coin wrapping station.

U.S. Pat. No. 3,000,160, to Speggiorin, issued Sept. 19, 1961, is similar in that it uses a turret. However, the patent employs recesses on the periphery of the turret sized to a particular diameter of coin and the turret is not only indexed for selection of the proper size recess but is also indexed during operations between three stations for stacking, wrapping, and discharge, respectively.

The automatic wrapping machines which employ turrets are complex in construction and require very expensive components. Thus, the turret itself requires extensive machining and assembly to maintain the alignment of parallel bores. The turret is also complex because of the number of parts which it must carry.

In accordance with our invention, we provide an automatic coin wrapping machine which will accommodate the wrapping of coins of different denominations and which utilizes simple, passive, removable coin tubes for each particular denomination. For coins of different denominations the only adjustments needed in the machine are coin diameter and thickness, and coin quantity adjustments for the coin count module, and a paper length adjustment, all of which adjustments are easily made.

SUMMARY OF THE INVENTION

The invention resides in a coin wrapping apparatus having a stationary coin tube with a central bore sized for a particular denomination of coin and an entrance extending along one side, coin count means for ejecting a predetermined quantity of coins of such denomination into the central bore of such coin tube, means for feeding paper to the coin tube, a filler pad adapted to close the entrance while coins are being ejected into the coin tube, and a rotating wrapping roller adapted to have its periphery project through the entrance to engage the paper and wrap the same about the stack of coins in the tube.

The invention further resides in a coin wrapping apparatus having a stationary coin tube with a central bore, coin count means for filling the central bore of the coin tube with a predetermined quantity of coins, means for feeding paper to the coin tube, a rotating wrapper roller adapted to engage the paper and wrap the same about the stack of coins in the tube, and a retractable coin stool extending into the bottom of the central bore of the coin tube and engageable with the bottom coin in the stack, such coin stool being movable within the central bore to position the coin stack and adapted to be vibrated up and down to jostle the coins.

The invention further resides in a paper feed for a coin wrapping apparatus in which a paper drive is actuated during the cycle of operation of the machine to bring paper to the entrance of a coin tube for wrapping of the paper about a stack of coins in the tube, and in which the drive is further actuated to bring the leading edge of the paper to a fixed point relative to the coin tube.

The invention also resides in the provision of controls for such coin wrapping apparatus in which the subsequent operation of the apparatus to form a coin roll is dependent upon the discharge from the apparatus of the previous roll, and in which the detection of loose coins in the discharge of the apparatus disables the apparatus.

It is an object of the invention to provide a simple, accurate automatic machine for wrapping coins of different denominations.

It is a further object of the invention to provide an automatic coin wrapping machine in which the changeover from coins of one denomination to another is provided by means of a removable coin tube which contains only passive elements and which is sized to coins of the particular denomination.

It is also an object of the invention to provide a combination coin support, coin jostler, and coin stack positioner operable within the coin tube and retractable from the coin tube to allow ejection of the formed coin roll out the bottom of the coin tube.

It is also an object of the invention to provide a variable length paper feed with means for automatically positioning the lead end of the paper relative to the wrapping station of the machine.

It is also an object of the invention to provide an automatic coin wrapping machine in which coins cannot be fed to form a stack if a previous stack of coins has not been formed into a wrapped roll which has exited the machine.

It is also an object of the invention to provide an automatic coin wrapping machine in which coins are fed from a hopper onto a rotating disc where they exit through a gate for engagement by an ejector belt and in which the end of the count of a particular stack of coins will halt the rotation of the disc and the belt drive and will raise the belt drive to a predetermined level more than one coin thickness above the discharge chute.

The foregoing and other objects and advantages of the invention will appear in the description which follows. In the description, reference is made to the accompanying drawings, which illustrate a preferred embodiment of the invention.

BRIEF DESCRIPTION OF THE DRAWINGS

FIG. 12 is a view in horizontal section taken in the plane of the line 12—12 of FIG. 2;

FIGS. 13 and 14 are views similar to FIG. 12 except showing the wrapper roller in alternative operating positions relative to a coin tube;

FIG. 15 is a view in vertical section, to an enlarged scale, showing the operation of the crimper blades to complete a formed coin roll;

DETAILED DESCRIPTION OF THE PREFERRED EMBODIMENT

General Description of the Machine

In general, the machine includes a hopper into which a batch of coins of a particular denomination are dumped. Coins are fed from the hopper to the rotating disc of a coin count module. The rotating disc carries the coins in single file to a discharge gate where they are engaged by an ejector belt. The ejector belt forces the coins past a star wheel which operates on a predetermined count control mechanism that accumulates the count of the coins being ejected. When the predetermined count is reached, the star wheel is held against further rotation, the disc and ejector belt stop rotating, and the ejector belt is lifted from engagement with the coins, thereby stopping the flow of coins out of the count module. In this manner a predetermined quantity of coins are fed from the count module.

The coins are directed into a removable coin tube sized for the particular denomination of coin to be wrapped. The coins are formed into a stack in the coin tube with the assistance of a vibrating coin stool projecting upwardly into the bore of the coin tube. After the stack has been formed, the stack is raised by the coin stool and paper from a roll is then fed into the coin tube about the stack of coins. A wrapping roller tightly forms the paper about the stack and the paper is cut automatically after the proper length has been fed. The paper length is determined by the position of a cut-off blade relative to the coin tube. Crimper blades engage the upper and lower ends of the tube of paper and crimp the top and bottom of the paper to form the completed coin roll. A coin pad, as well as the coin stool, are removed from the bottom of the coin tube so that, upon the retraction of the wrapping roller, the coin roll will fall out the open bottom of the coin tube into a discharge chute. The exiting of the completed roll is the signal for the repeat of the foregoing steps to form a subsequent roll.

HOPPER AND COIN COUNT MODULE

Figure 1:
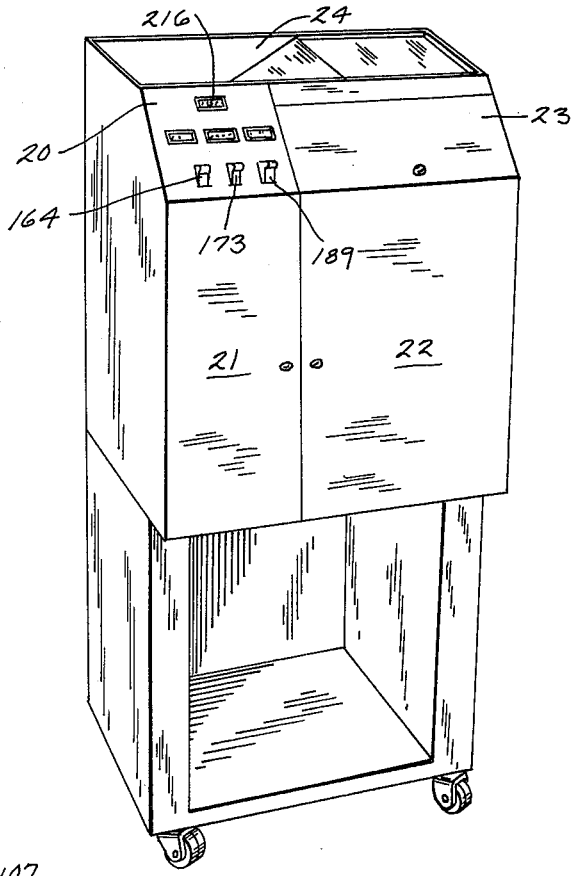
FIG. 1 is a view in perspective of an automatic coin wrapping machine in accordance with the invention.

Referring to the drawings, the machine has an outer housing which includes an inclined control panel 20, left and right hinged front doors 21 and 22, a hinged inclined top cover 23 located to the right side of the control panel 20, and a hopper 24 formed in the left side of the top of the machine. The machine may be mounted on a mobile cart as illustrated in FIG. 1.

The hopper 24 has converging inclined walls which lead to a horizontal conveyor belt 25 arranged at the open bottom of the hopper 24. The hopper conveyor belt 25 is driven by a hopper motor in a controlled manner to carry coins deposited in the hopper 24 to the top surface of the rotating disc 26 of a coin count module indicated generally by the numeral 27. The coin count module 27 is generally known per se and is of the type illustrated and described in U.S. Letters Pat. No. 3,138,166 issued June 23, 1964 to Arnold R. Buchholz for "Control Mechanism for Coin Counting Machines" and assigned to the assignee of this invention. Reference should be had to such patent for details of the construction and operation of the coin count module 27. The module is modified for use in the present invention and such modifications will be described hereafter.

The rotating disc 26 forms the bottom of a relatively shallow hopper defined by an upstanding annular flange 28. Coins are carried along the rotating disc 26 by centrifugal force into an adjustable gate opening and to a discharge track. In the typical coin count module, coins in the discharge channel are engaged by a rubber coated ejector wheel and forced past a star wheel. In the modified coin count module 27 of this invention, the coins are engaged by an ejector conveyor belt 29 driven by a rear ejector pulley 30 and extending about an idler pulley 31 and a front ejector pulley 32. The lower run of the ejector conveyor belt 29 passes over the gap formed between left and right track portions 33 and 34, respectively. The left track portion 33 is fixed and the right track portion 34 is movable for adjustment relative to the left track portion 33 to vary the gap between the two track portions. Each of the track portions 33 and 34 mounts a rail plate 35 and 36, respectively, which have their opposing edges set in from the edges of the track portions 33 and 34.

As coins travel down the track, opposite sides of a coin will be engaged between the rails 35 and 36 on the shoulders formed by the track portions 33 and 34. If a coin having a smaller diameter than the setting of the track is fed down the track, it will fall into the space between the rails 33 and 34 and into an off-sort chute (not shown) to a point of collection. Thus, if the count module is set to handle pennies, and one or more dimes are inadvertently placed in the machine along with the mass of pennies, those dimes will be sorted off in the track portion. Coins of different denomination and having a larger diameter will be rejected by the rotating disc 26 since they will not pass into the discharge gate. Coins of a proper denomination will travel along the track under the urgings of the ejector belt 29 and will be forced past a star wheel 37. The star wheel 37 operates upon a predetermined count control mechanism 38 of the type illustrated and described in the aforesaid U.S. Pat. No. 3,138,166.

The rear ejector pulley 30 is mounted on an ejector wheel shaft 39. The front ejector pulley 32 is mounted on a front ejector wheel support 40 which is journaled at its rear on the ejector wheel shaft 39. The idler pulley 31 is also mounted on the front ejector support 40. The rear ejector support 40 together with the idler pulley 31 and front pulley 32 may be pivoted about the ejector wheel shaft 39. An extension **40*a* of the front ejector support 40 mounts a spring loaded ejector support plunger 41 having a knob 42 on its outer end and adapted to have its inner end received in a detent in the front face of a rear ejector support 43. The rear support 43 is also journaled on the ejector wheel shaft 39. When the plunger 41 is in the detent in the rear support 43, the entire assembly of rear and front supports 43 and 40 with the ejector belt 29 and its pulleys 30, 31 and 32 acts as a single ejector unit. The rear support 43 is movable between an upper position in which the entire ejector unit will be positioned such that the ejector belt 29 will be above the level at which it can engage the top surface of a single coin in the track. Under the urgings of an ejector solenoid, the rear ejector support 43 is pulled downwardly so that the ejector unit is moved downwardly and the ejector belt 29** will engage coins in the track.

Although the entire ejector unit will function as such so long as the plunger 41 is in the detent in the rear ejector support 43, by pulling on the knob 42 and releasing the plunger 41 from the detent, the front ejector support 40 together with the front pulley 32 and idler pulley 31 can be pivoted about the ejector wheel shaft 39 to allow access to the track for inspection or for clearing the track of debris or mutilated coins.

A single disc motor 44 is connected by spiral gearing to rotate the disc 26 and by suitable belting to rotate the ejector wheel shaft 39 and thus drive the ejector conveyor belt 29.

In a known manner, the coin count module 27 is provided with a lever 45 which can be manipulated to adjust the height of the discharge gate to that required for a particular denomination of coin. A second lever 46 is provided to adjust the width of the track for the particular denomination. Also as is known, the star wheel shaft is connected by bevel gearing to a resettable counter 47 and the predetermined count control 38 can be set by another lever 38' for predetermined counts in increments of five coins, or can be set for bagging in which case the count control mechanism 38 is disabled.

The hopper conveyor belt 25 deposits coins from the hopper 24 onto the disc 26 to one side of its axis of rotation. A depending level control spring 48 is mounted adjacent the flange 28 to assist in leveling the coins on the disc 26 and to act as one contact of a switch which senses when the build-up of coins on the disc becomes excessive.

As is known, the count control mechanism 38 will operate to halt the counting and ejection of coins when the last coin of the predetermined count passes the star wheel. Specifically, the halting of counting and ejecting is accomplished by the actuation of an ejector switch which deenergizes an ejector solenoid so that the ejector unit is moved away from engagement with coins in the discharge track thereby removing the force necessary to move coins past the star wheel. In the machine of the present invention, the actuation of the ejector switch also removes power from the disc motor 44 and the motor which drives the hopper conveyor belt 25. After the predetermined count has been reached, the mechanism will physically block further rotation of the star wheel and must be reset to allow for a subsequent predetermined count. Reset is accomplished either by a manual reset handle 49 or automatically by a start count solenoid which trips the reset mechanism.

STACKING AND WRAPPING MECHANISM

Coins leaving the count module 27 are ejected to an inclined packaging chute 50. The packaging chute 50 directs the coins to an upper tapered opening 51 of a removable coin tube 52. The coin tube 52 has a lower central bore 53 which is specifically dimensioned to accommodate a single denomination of coin. The coin tube 52 has a generally circular cylindrical outer surface rising from a circular cylindrical base 54. Immediately above the base 54, flats are machined in the outer surface of the tube to form a generally triangular cross section portion 55. As shown in FIGS. 12–14, the central bore 53 intersects the two front faces of the triangular portion 55 to form longitudinal openings 56. A pair of idler rollers 57 are mounted at their ends in bearings on the coin tube 52 and their peripheries project slightly through the openings 56 into the central bore 53. The third and rear face of the triangular portion 55 forms an additional opening with the central bore 53 to provide an entrance 58. The rear face and the entrance 58 extend vertically above the triangular portion 55.

Figure 2:
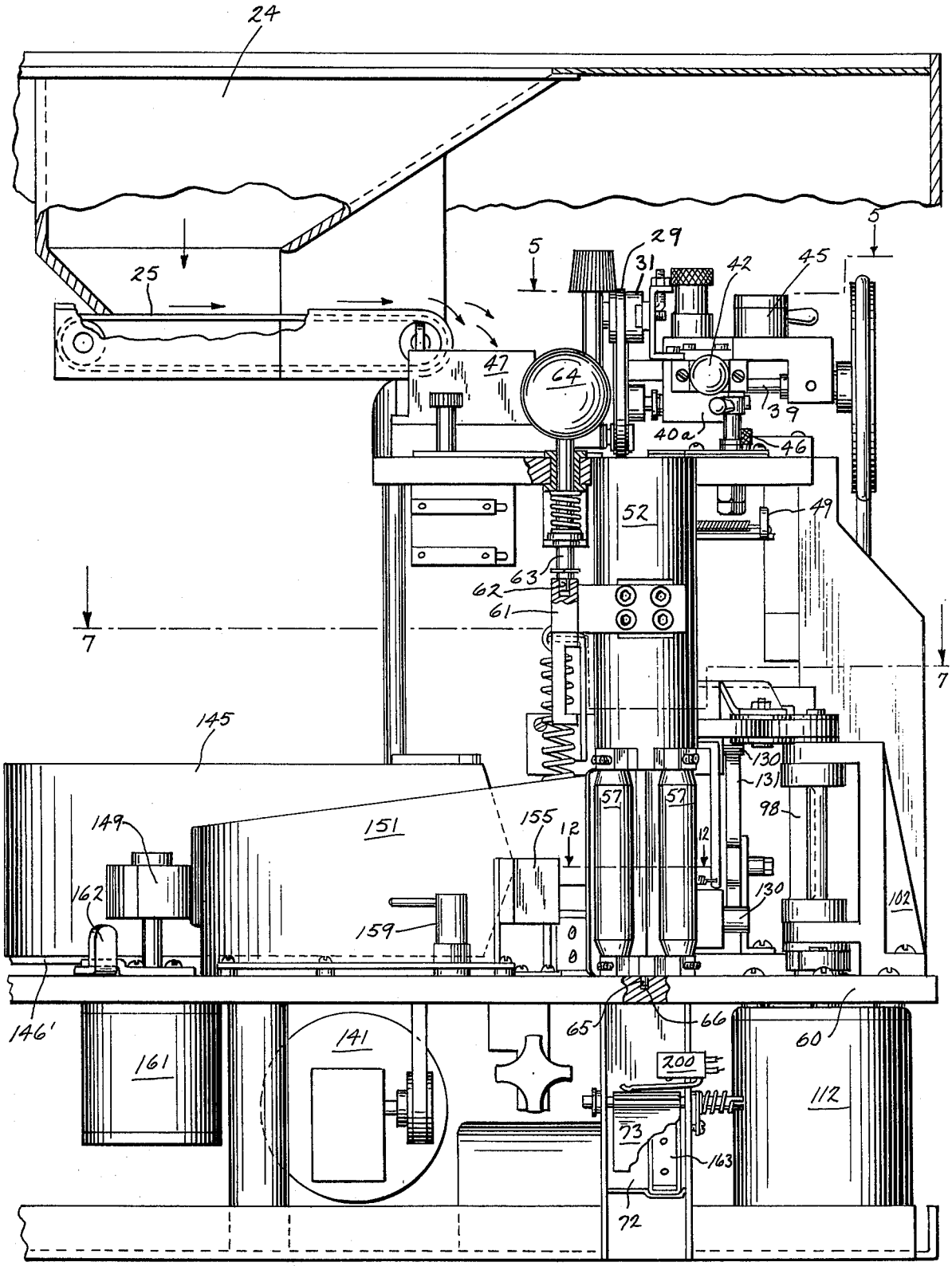
FIG. 2 is a front view in vertical elevation, and partially in section, of the coin wrapping machine with the outer enclosure removed except for the top including the hopper.
Figure 3:
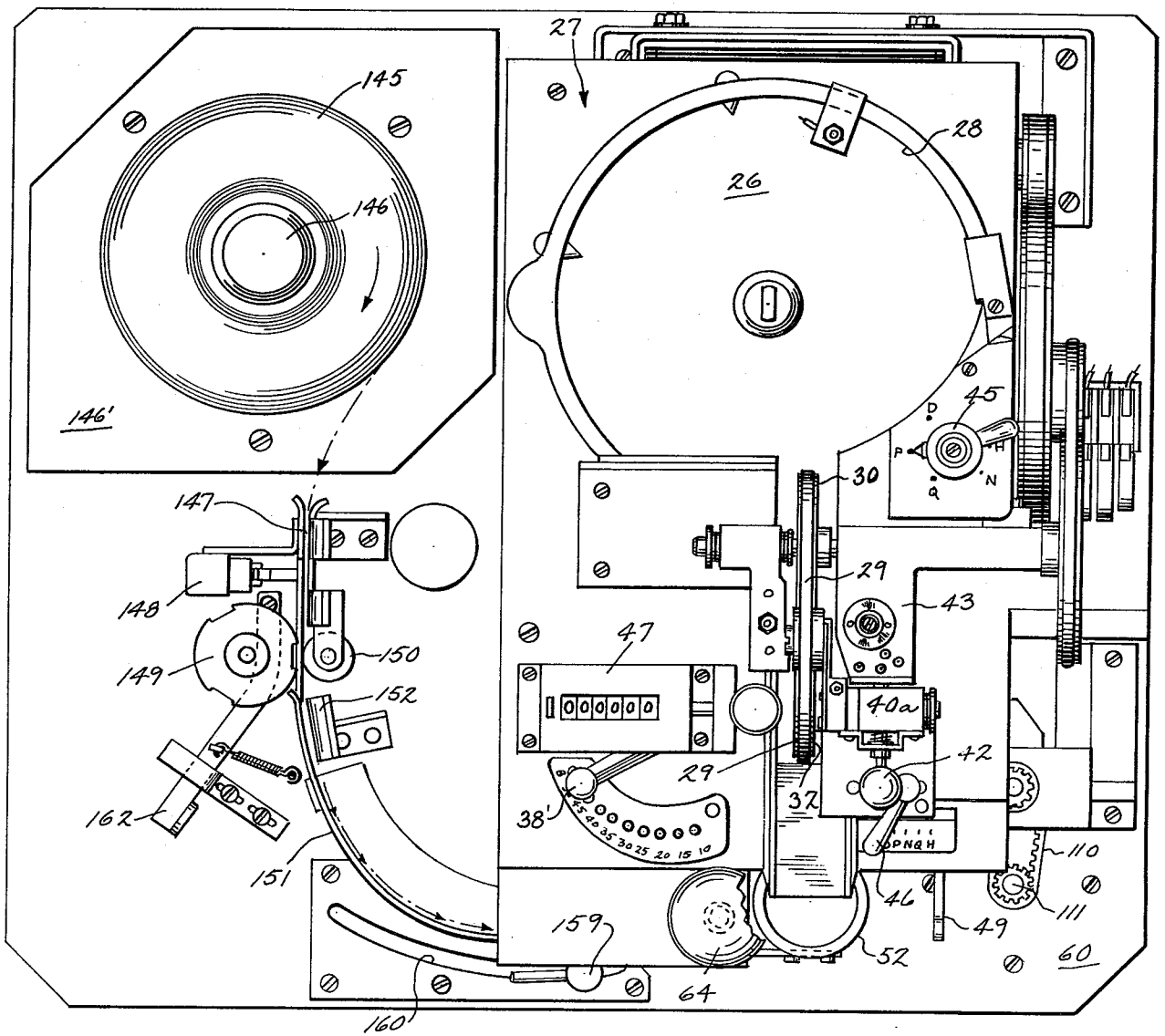
FIG. 3 is a top plan view of the coin wrapping machine viewed from a level beneath the hopper.
Figure 4:
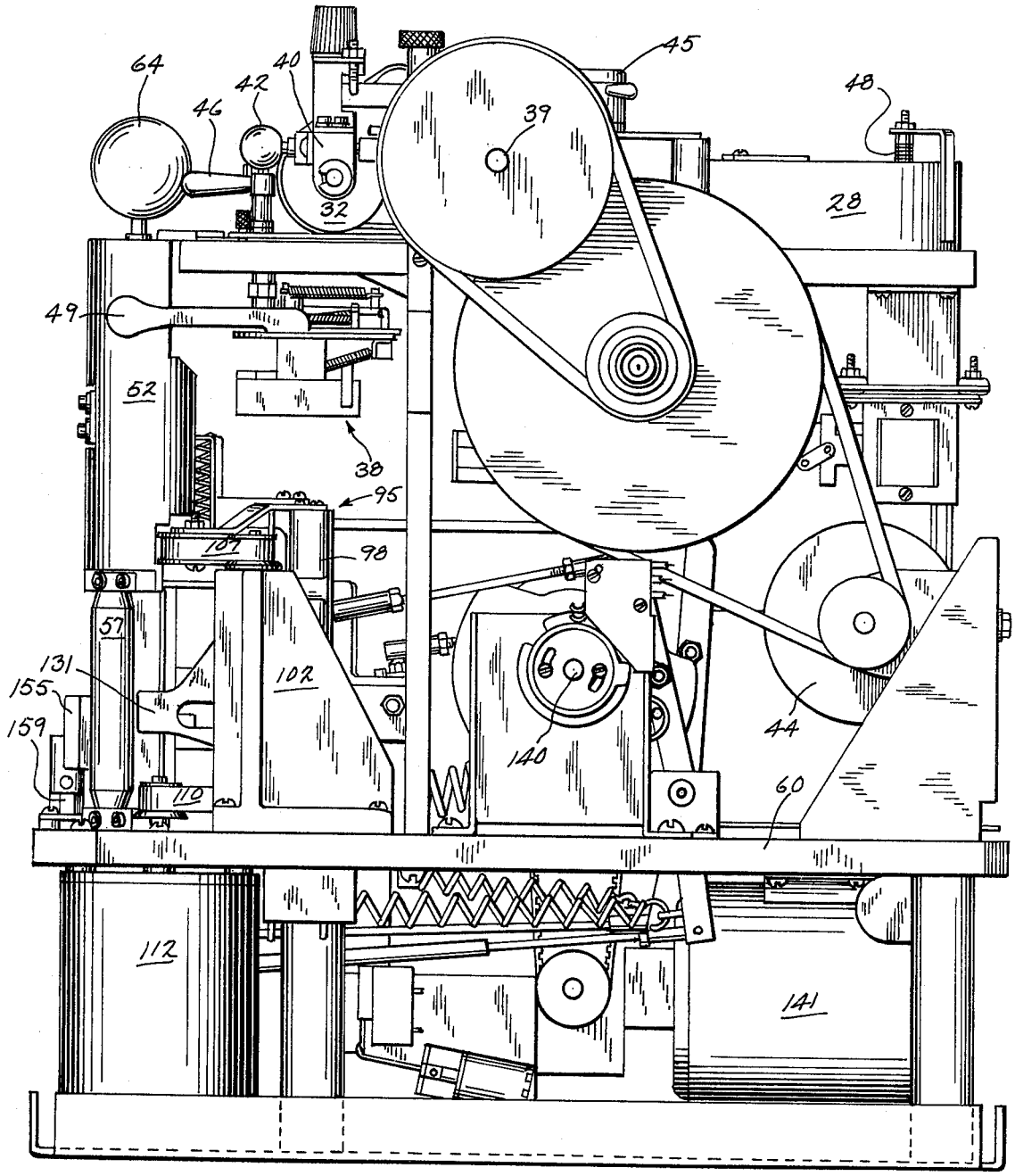
FIG. 4 is a view in elevation taken from the right hand side of the machine with the outer enclosure removed.
Figure 5:
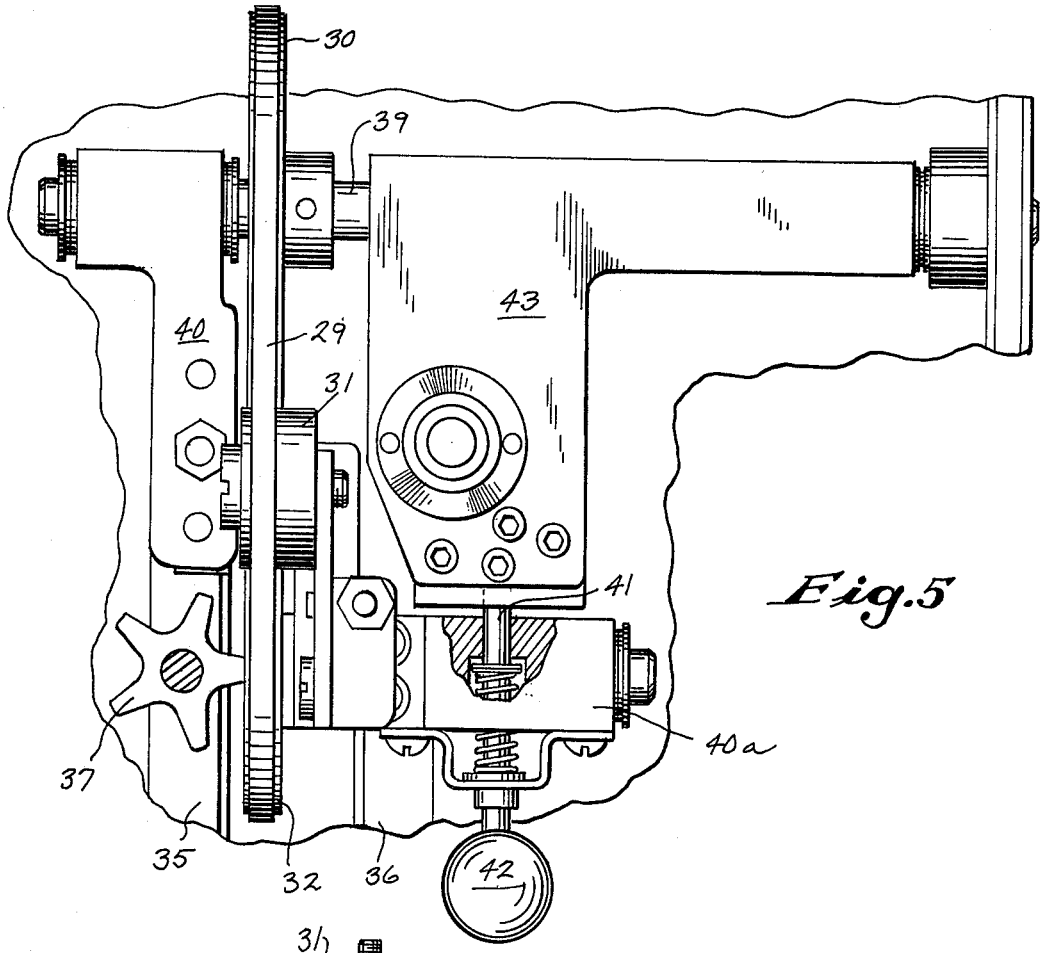
FIG. 5 is a top plan view, and partially in section, of the coin ejector mechanism of the count module of the machine and viewed from the plane of the line 5—5 of FIG. 2.
Figure 6:
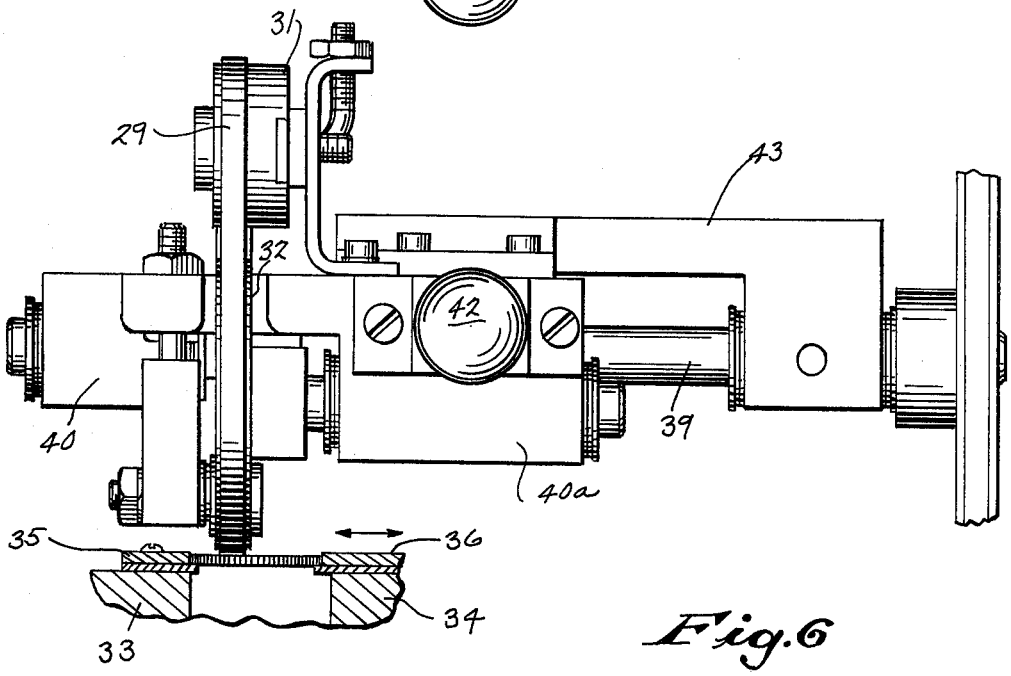
FIG. 6 is a front view in elevation, and partially in section, of the coin ejector mechanism of FIG. 5.
Figure 10:
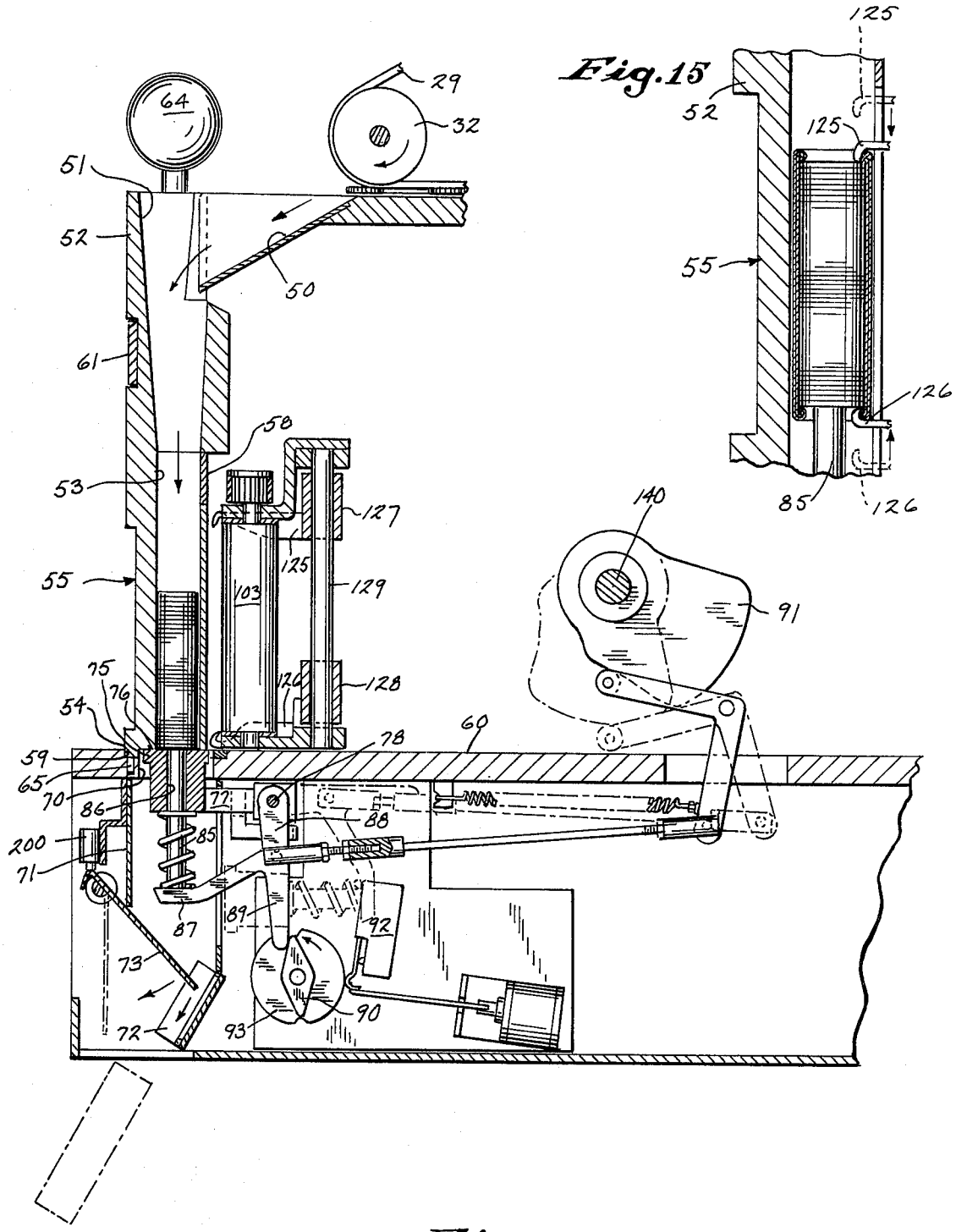
FIG. 10 is a view in elevation and partially in section taken in the plane of the line 10—10 of FIG. 7.

Referring to FIGS. 2 and 10, the coin tube 52 is located in place within the machine and secured by placing the coin tube base 54 in a shallow counter bore 59 disposed in the upper surface of a main floor plate 60 and by locking a block 61 in place. The block 61 extends from one side of the coin tube 52, and it has a recess 62 which receives the stub end of a spring loaded rod 63. The spring loaded rod 63 has a large knob 64 which can be grasped by the operator to pull the rod 63 upwardly to release the block 61. The coin tube 52 is further located by means of a pin 65 extending from the underside of the base 53 and received in a bore 66 in the floor plate 60.

As previously indicated, a separate coin tube 52 is provided for each denomination of coin to be handled. Each coin tube 52 has its central bore 53, together with the upper tapered opening 51 sized for the specific diameter of coin, plus wrapper thickness, represented by the respective denomination. The coin tubes are easily and quickly changed by simply pulling upwardly on the knob 64 thereby releasing the coin tube 52 and allowing it to be lifted out and replaced with a coin tube for a different denomination.

The floor plate 60 has an opening 70 coaxial with the counterbore 59 and in line with the central bore 53 of a coin tube 52 when the tube is in place. A square tube extension 71 surrounds the opening 70 and extends downward from the underside of the floor plate 60. The extension 71 leads to an inclined discharge chute 72, and the extension 71 and discharge chute 72 are normally blocked by a pivotable exit door 73.

Figure 11:
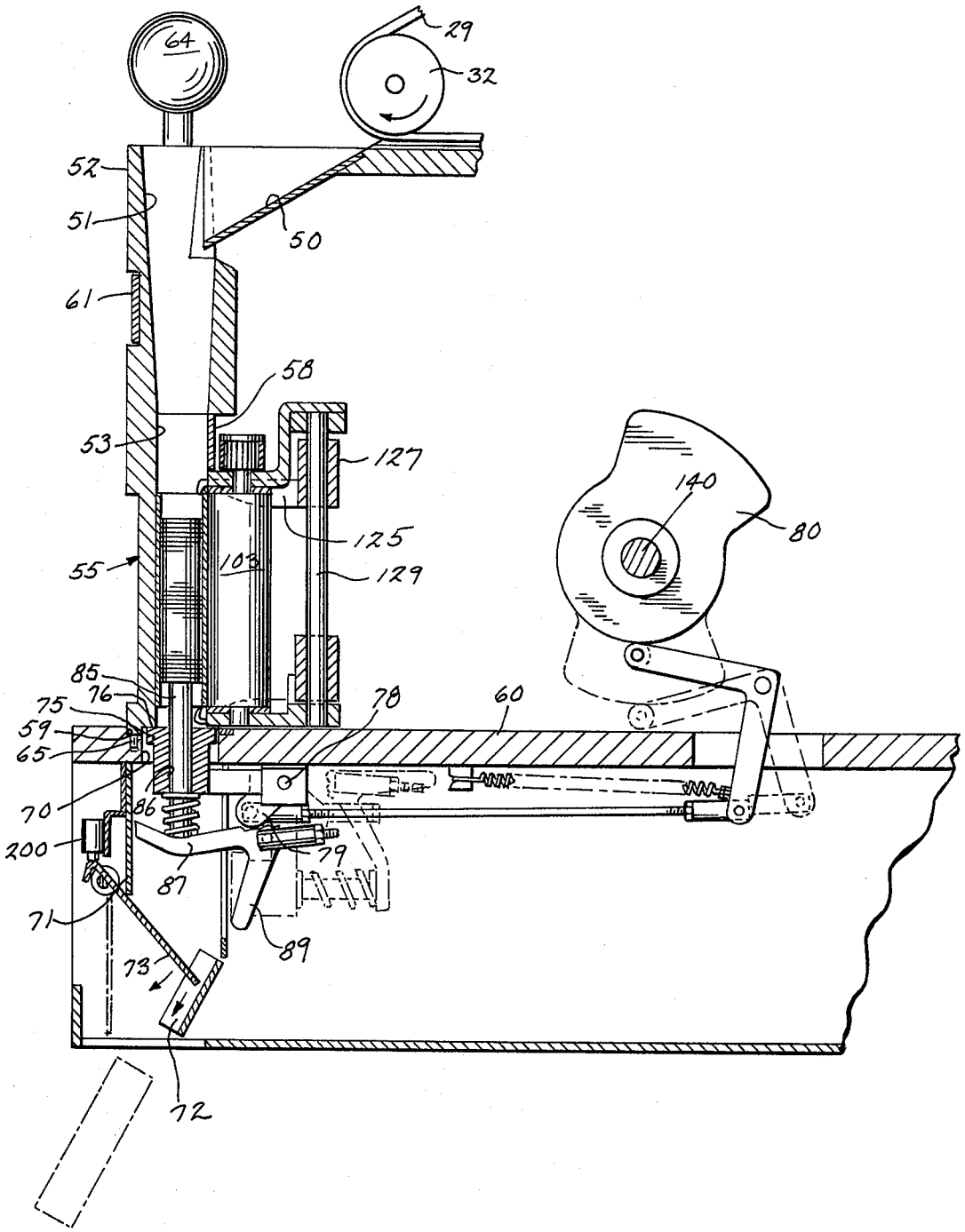
FIG. 11 is a view in elevation and partially in vertical section taken in the plane of the line 11—11 of FIG. 7.

When a coin tube 52 is in place, the bottom open end of the central bore 53 may be closed by a generally cylindrical coin pad 75 which extends into the floor opening 70 and has its upper surface in the plane of the top surface of the floor plate 60. The coin pad 75 is mounted on the end of an arm 77 which projects through an opening in the extension 71, and the arm 77 is mounted on a pivot 78. A crank lever 79 is secured to the arm 77 and is also mounted on the pivot 78. Under the control of a coin pad cam 80, the coin pad 75 is movable between its position in which it functions to close the floor opening 70 and a position in which it is swung out of the way and thus removed from the floor opening 70 and out of the path of completed coin rolls falling from the central bore of the coin tube. The alternate positions of the coin pad are shown in FIG. 11.

Referring to FIG. 10, a rod-like coin stool 85 is movable in a central bore 86 in the coin pad 75. The bottom end of the coin stool 85 rests on one leg 87 of a coin stool crank 88. A second leg of the coin stool crank 88 is mounted on the pivot 78 and a third leg 89 is adapted to be engaged by a generally diamond-shaped jog cam 90. The coin stool crank 88 can be pivoted between three general positions, as follows. In its fully extended position, the first leg 87 of the crank 88 will be within the extension 71 and will have raised the coin stool 85 to lift a stack of coins supported on the stool 85 (see FIG. 11). In its second, intermediate position, the first leg 87 is disposed within the extension 71 beneath the floor opening 70 and with the second leg 89 disposed in the path of rotation of the two ends of the jog cam 90. In its third, withdrawn position, the crank 88 is retracted from the extension 71. The positioning of the coin stool crank 88 is under the control of a coin stool cam 91. The second and third positions of the coin stool crank 88 are illustrated in FIG. 10.

The jog cam 90 is adapted to be rotated to engage the second leg 89 of the coin stool crank 88 at every half revolution and to thereby pivot the crank 88 through a small arc to cause the coin stool 85 to be moved upwardly. This constant vibrating action will jostle the coins in the tube 52 to assist in producing a proper stack of coins by assisting in the settling of the coins. The rotation of the jog cam 90 is controlled by an indexing switch 92 which has its actuator arm riding the periphery of an index cam 93 mounted on the same shaft which mounts the jog cam 90. The index cam 93 has recesses at opposite points on its periphery corresponding with the location of the ends of the jog cam 90. The indexing switch 92 is normally closed to allow the jog cam 90 to be driven but will open if its actuator arm moves into one of the recesses on the index cam 93. The jog cam 90 will then be stopped at a position in which its ends do not interfere with the coin stool crank 88. The indexing switch 92 is prevented from being actuated by a solenoid 94 connected to the end of the actuator arm of the indexing switch 92.

Figure 8:
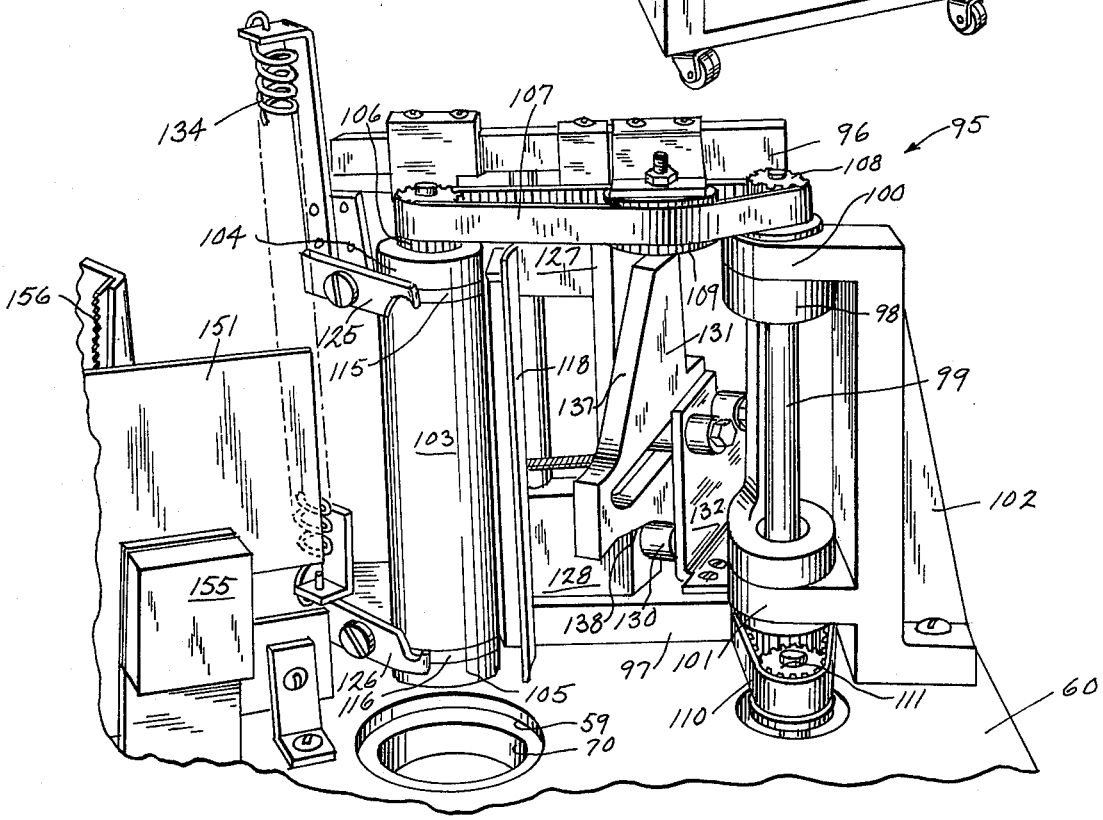
FIG. 8 is a partial view in perspective of the wrapper roller and crimper assembly of the machine, with the coin tube removed for clarity.
Figure 7:
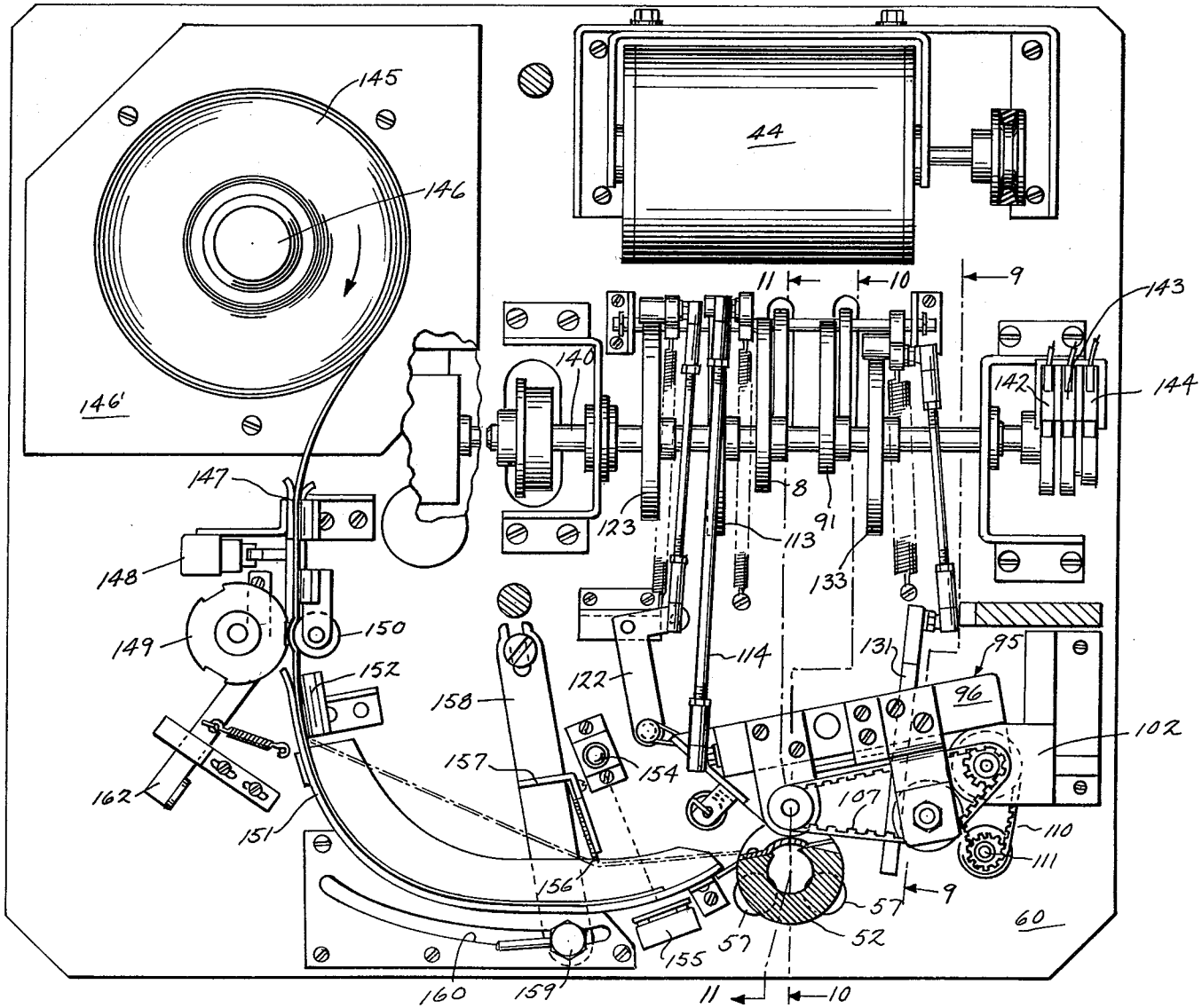
FIG. 7 is a view in horizontal section taken in the plane of the line 7—7 of FIG. 2.

Referring to FIGS. 7 and 8, a wrapping roller and crimper assembly indicated generally by the reference numeral 95 is formed of upper and lower plates 96 and 97, respectively. The plates 96 and 97 are spaced apart at one end by a bearing cage 98 having upper and lower bearing portions which surround a drive shaft 99. The drive shaft 99 is also journaled in bearings mounted in upper and lower arms 100 and 101, respectively, of a standard 102 mounted on the floor plate 60 at a position adjacent the floor opening 70. A wrapping roller 103 is mounted at each end in bearings 104 and 105 formed in the ends of spaced arms projecting outwardly from the upper and lower plates 96 and 97, respectively. The wrapping roller 103 is disposed at an end of the assembly 95 opposite to the pivotal mount of the assembly 95 on the drive shaft 99. Projecting upwardly through the upper bearing 104 is a roller shaft mounting a drive gear 106. The drive gear 106 is driven from the drive shaft 99 by means of a toothed rubber belt 107 which engages a pinion 108 on the upper projecting end of the drive shaft 99 and which also extends around an idler gear 109 mounted from the upper plate 96. The drive shaft 99 is driven by a lower toothed belt 110 which connects the drive shaft 99 with a motor shaft 111 of a wrapper motor 112. As can be seen in FIGS. 7 and 8, the arrangement of the mounting of the assembly 95 on the drive shaft 99 and the arrangement of the drive belts from the motor shaft 111 to the wrapping roller 103 is such that the wrapping roller 103 can be driven regardless of its relative pivotal position with respect to the drive shaft 99. The entire assembly 95 is pivotable about the drive shaft 99 under control of a wrapping roller cam 113 which controls a cam follower rod 114 connected to the end of the assembly 95 opposite to the pivotal connection on the drive shaft 99 (see FIG. 7).

Referring to FIGS. 8 and 12–14, a filler pad assembly is mounted on the same shaft as the wrapping roller 103. The filler pad assembly has spaced upper and lower arms 115 and 116 pivotally mounted on the wrapper roller shaft above and below the wrapper roller 103. A block 117 extends vertically between the upper and lower arms 115 and 116 and a filler pad 118 is mounted on a surface of the block 117. The filler pad 118 has an arcuate portion 119 adapted to bridge the entrance 58 of a coin tube 52. A curved shield 120 extends from an opposite side of the block 117 and generally surrounds, but is spaced from, the wrapping roller 103. The shield 120 is partially wrapped by a cable 121 attached at one end to the block 117 and at its other end to a leg of a bell crank lever 122. The bell crank lever 122 is pivotally attached to a support extending upwardly from the floor plate 60 and is controlled by a filler pad cam 123. A tension spring 124 is connected to the end of the shield 120 to urge the shield 120, block 117, and filler pad 118 in a clockwise direction as viewed from above to a position where the arcuate portion 119 will confront the entrance 58.

Figure 9:
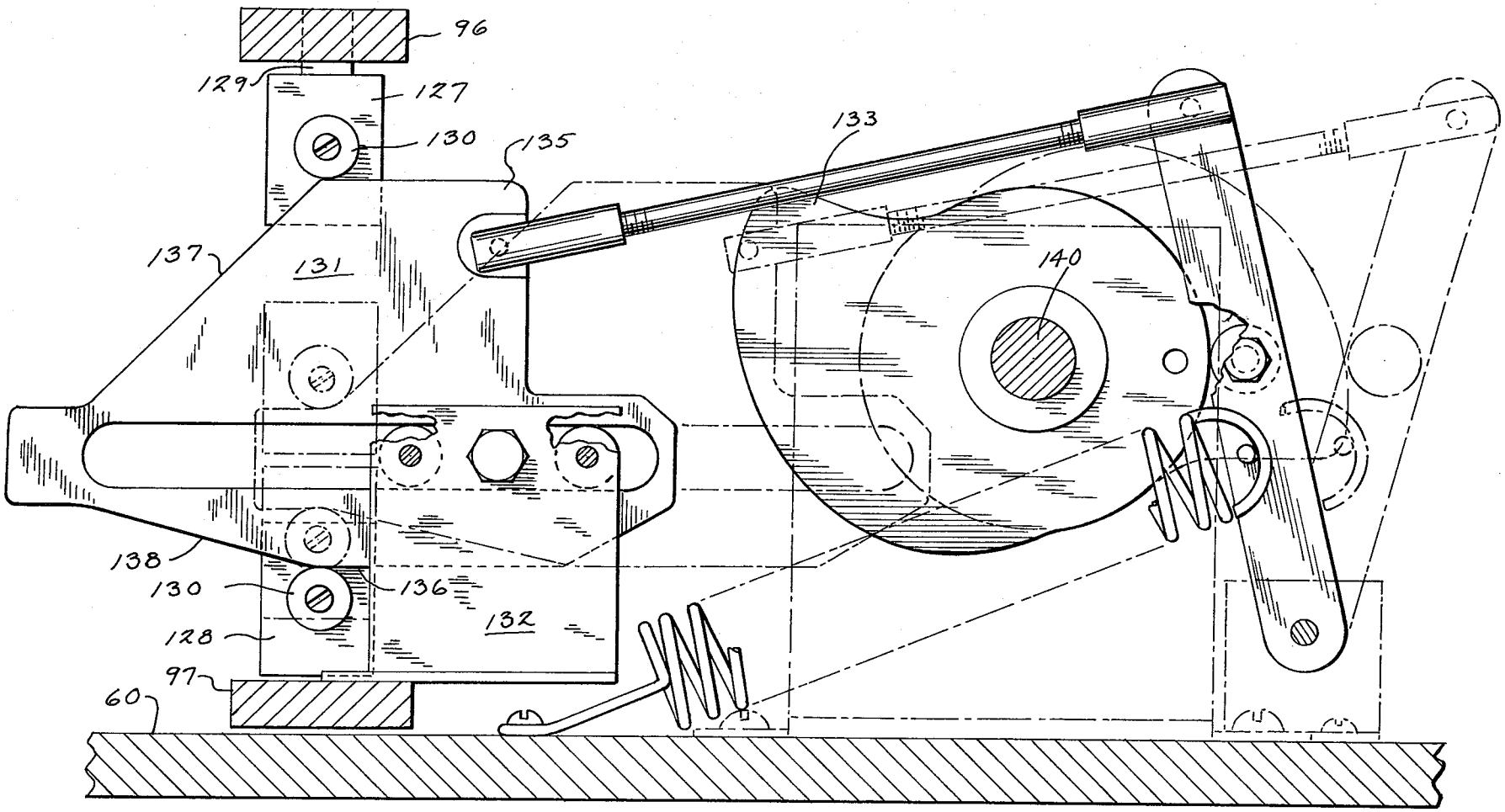
FIG. 9 is an enlarged view in elevation of the mechanism for actuating the crimper blades.

Upper and lower crimper blades 125 and 126, respectively, are also mounted on the wrapping roller assembly 95. The upper and lower blades 125 and 126 each extend outwardly from hollow cylindrical slides 127 and 128, respectively, which are mounted on a rod 129 extending between the upper and lower plates 96 and 97 of the assembly 95. The slides 127 and 128 each include rollers 130 mounted on a side of the slide and disposed one above the other. The rollers 130 are engaged by the upper and lower surfaces of a crimper cam plate 131. As shown in FIG. 9, the crimper cam plate 131 is slidably mounted for movement between the rollers 130 and parallel to the upper surface of the floor plate 60. The crimper cam plate 131 is mounted on a bracket 132 extending from the lower plate 97 of the assembly 95. The in and out position of the cam plate 131 is controlled by a crimping cam 133, as shown in FIG. 9. The upper and lower crimping blades 125 and 126 are normally urged towards each other by the force of a tension spring 134 mounted at its respective ends in brackets secured to the upper and lower crimping blades 125 and 126 (see FIG. 8). Accordingly, the rollers 130 of the upper and lower slides 127 and 128 will be urged by the spring 134 against the respective upper and lower surfaces of the crimper cam plate 131.

As shown in FIG. 9, in one position the crimper cam plate 131 holds the rollers 130 apart against respective parallel upper and lower cam surfaces 135 and 136. As the crimper cam plate 131 is withdrawn under the action of the crimping cam 133, the roller 130 of the upper slide 127 can travel down a rapidly descending cam surface 137 while the roller 130 of the lower slide 128 will travel up a gently rising cam surface 138. When the crimping cam plate 131 is fully withdrawn, the rollers 130 could be in contact with the narrowest point of the cam plate 131. As the rollers 130 and therefore the slides 127 and 128 approach each other upon withdrawal of the cam plate 131, the crimping blades 125 and 126 will similarly approach each other.

Provision is made to prevent the crimper blades 125 and 126 from contacting the top and bottom coins respectively in the stack to thereby prevent objectionable marring of the coins. Since the position of the bottom coin in the stack during wrapping and crimping is controlled by the coin stool 85 and will be the same for any denomination, the permitted upward travel of the lower crimping blade 126 is controlled directly by the crimper cam plate 131. The height of the stack will, of course, vary depending upon the denomination. Therefore, to control the maximum downward movement of the upper crimper blade 125, an upper crimper stop 139 is provided which extends downwardly from the underside of the block 61 of the coin tube 52 and which includes a surface 139' disposed in the path of travel of the upper crimper blade 125 as it moves downwardly. Each coin tube is provided with such a crimper stop sized to suit the stack height of the denomination to be handled by the coin tube.

Each of the cams for actuating and operating coin stool, coin pad, wrapping roller, filler pad, and crimpers are mounted on a single cam shaft 140. As shown in FIG. 7, the cam shaft 140 is driven by a cam shaft motor 141 and mounts the filler pad cam 123, the wrapping roller cam 113, the coin pad cam 80, the coin stool cam 91, and the crimping cam 133, in that order. An outboard end of the cam shaft 140 also mounts three timing cams which operate a homing switch 142, a paper feed switch 143 and a service limit switch 144, in that order.

PAPER FEED

Paper stock for the coin wrappers is fed from a continuous roll 145 having a core which can be slipped over an upstanding standard 146 which rises from a paper table 146'. Paper from the roll 145 is threaded first between opposed plates forming a gate 147, then past the feeler arm of a paper switch 148, then past a paper feed roller 149 and its cooperating idler roller 150 to a passage between the start of an arcuate guide plate 151 and a cooperating bracket 152. The paper will travel along the inner surface of the guide plate 151 and be directed to the wrapping station. After leaving the guide plate 151, the leading edge of the paper will encounter a ramp plate 153 mounted as an extension of the rear face of the triangular portion 55 of the coin tube 52 which contains the entrance 58. As shown in FIG. 7, a light source 154 and a photoelectric cell 155 are arranged on opposite sides of the path of travel of the leading edge of the paper along the inner surface of the guide plate 151 and near the wrapping station.

A serrated, V-shaped knife blade 156 is held on a bracket 157 extending upwardly at an intermediate point on a lever arm 158. The lever arm 158 has one forked end engaging a pivot on the floor plate 60 and its other end mounts a hold-down bolt 159 which works in a slot 160 whose radius is defined about the pivot point of the lever arm 158. Thus, the position of the knife blade 156 relative to the wrapping station can be varied by loosening the hold-down bolt 159 and moving the lever arm 158 about its pivot. Such adjustment is necessary to compensate for the different length requirements of wrappers for different denominations.

To assist in threading the end of a paper roll into the machine, there is a flexible connection between the shaft mounting the paper feed roller 149 and the paper feed drive motor 161. A spring biased lever arm 162 bears against the shaft for the paper feed roller 149 so that the paper feed roller can be moved away from the idler roller 150 by movement of the lever arm 162. The paper feed roller 149 is spring biased towards the idler roller 150 and is provided with voids or skips in its driving surface to allow the paper to be skip-fed, thereby preventing climbing of the paper upward along the inner surface of the guide plate 151 as the paper is being fed.

OPERATION OF MECHANISMS

Figure 16:
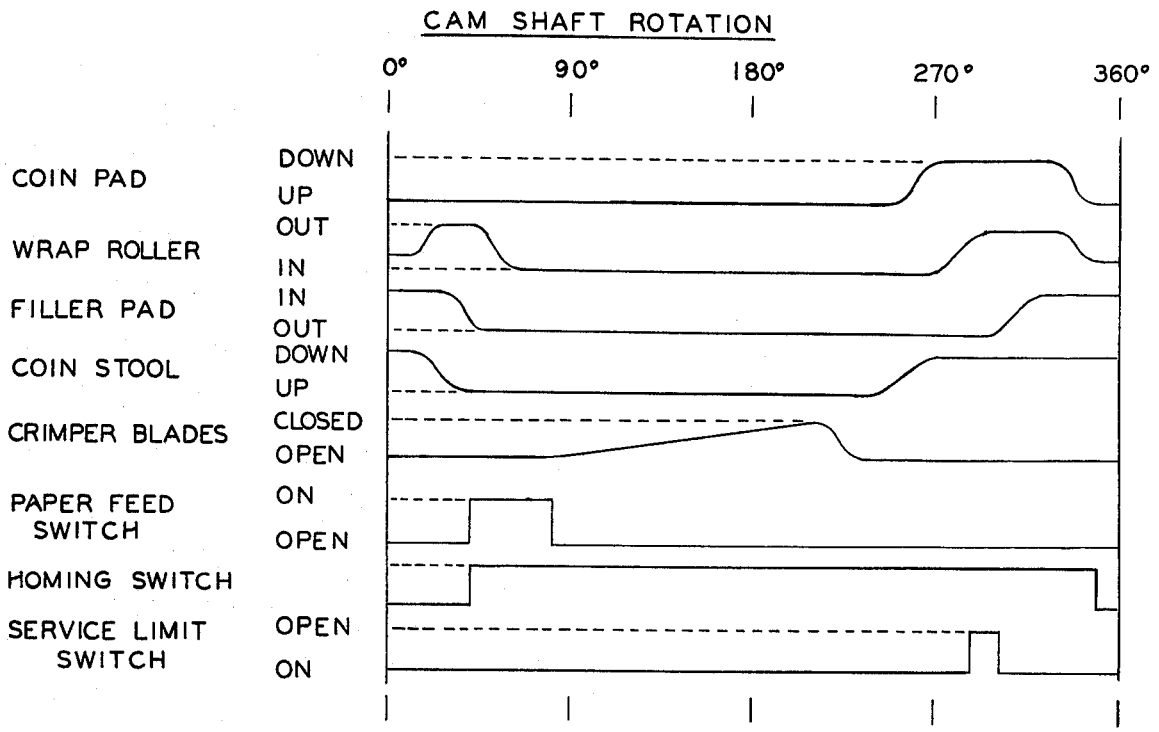
FIG. 16 is a schematic representation of the timing and operation of various cams and switches of the machine in relation to rotation of the cam shaft.

The coordinated operation of the elements to first produce a stack of coins within the central bore of the coin tube, to wrap a length of paper about the stack, to crimp the ends of the paper tube to form the complete roll, and then to eject the roll, can be understood more readily by reference to FIG. 16 which is a chart of the operation of the various cams and switches controlled by the cam shaft 140 in relation to one complete rotation of the cam shaft 140. The chart begins at zero rotation, which is arbitrarily chosen as the time during which the cam shaft 140 is stopped and coins of a predetermined quantity are fed from the count module 27 into the open funnel end 51 of the coin tube 52. At this time the coin pad 75 is in place beneath the open end of the coin tube 52. Also at this time, the homing switch 142 will be actuated to drive the jog cam 90 which will engage the second arm 89 of the coin stool crank 88 causing the coin stool 85 to be vibrated upwardly to contact the bottom of the stack being formed and thereby assist in the settling of the coins into a proper, compact stack. At this same time, the wrapping roller cam 113 will have positioned the wrapping roller assembly 95 at an intermediate position near the coin tube 52 with the filler pad 118 closing the entrance 58. When all coins have been ejected into the tube 52, and the cam shaft 140 begins its rotation, the stool 85 will at first continue to vibrate the coin stack. After a small degree of rotation of the cam shaft 140, the wrapping roller assembly 95 will be returned to its outermost position away from the coin tube 52 and the coin stool 85 will begin to move upwardly to lift the stack of coins off of the coin pad 75. Also at this time, the filler pad cam 123 will move the crank 122 to pull the cable 121 to move the filler pad 118 out of the way so that when the wrapping roller assembly 95 is next positioned inwardly the wrapping roller 103 can confront the entrance 58.

When the coin stool 85 has been raised to its highest position, the homing switch 142 will close to stop operation of jog cam 90. At this point the paper feed switch 143 is closed and the feed roller 149 will extend the roll of paper and feed the leading edge of the paper to the coin tube 52. After the paper begins to be fed, the wrapping roller assembly 95 will be moved to an inward position where the wrapping roller 103 can contact the stack of coins to rotate the stack and to engage the leading edge of the wrapper blank to pull the paper over the ramp 153 and into the coin tube 52. Since the wrapping roller 103 is driven at a high speed relative to the feed of the paper, the paper will be pulled by the wrapping roller 103 and will stretch between the coin tube 52 and the bracket 152. This will force the paper against the knife blade 156 and will cut the paper to the desired length. The wrapping roller 103 winds the paper about the rotating stack of coins with the assistance of the idler rollers 57.

The cutting of the roll of paper by the knife blade 156 will cause actuation of the photocell 155 by receiving a beam of light from the source 154. This will provide an alternative circuit for energization of the feed roll drive motor 161 so that the paper will be advanced after the prior wrapper blank has been severed and until the leading edge of the roll again blocks the beam of light from the source 154.

At this point in time the stack has been formed and the wrapper blank has been tightly wrapped about it. The wrapped stack is continued to be rotated by the wrapping roller 103. Continued rotation of the cam shaft 140 will now cause the crimper blades 125 and 126 to be moved together. As they encounter the extending upper and lower ends of the paper tube formed about the stack, the crimper blades 125 and 126 will crimp those ends as the paper tube and stack are rotated by the wrapping roller 103 and seal the completed roll (see FIG. 15).

When the crimping is completed the crimping blades 125 and 126 will be retracted to their open position. At the same time the coin stool 85 will be moved downwardly and, with the coin pad 75, will be moved out of the way so that both the coin pad and coin stool will vacate the tube extension area and the opening 70 in the floor plate 60 will be clear. For a short period of time the wrapping roller 103 will continue to be in its inward position thereby supporting the completed coin roll. Then, when the wrapping roller assembly 95 is moved outwardly, the coin roll will fall down through the floor opening 70, out the extension 71 and past the door 73. Continued rotation of the cam shaft 140 will reset the operating elements for the subsequent filling of the tube and wrapping of a new stack of coins.

LOOSE COIN DETECTION

If the machine should malfunction and form either no roll or an incomplete roll of coins, the condition is determined by sensing the presence of loose coins in the discharge chute 72. Specifically, the discharge chute has a bottom floor which includes a spill contact plate 163 which forms a part of the bottom of the chute but which is electrically insulated from the remainder of the chute. The chute itself is connected to ground and the spill contact plate 163 is connected to a d-c power source (as will be more fully described hereafter). When loose coins strike the discharge chute 72 they will bridge between the spill contact plate 163 and the remainder of the chute 72 and complete an electrical circuit.

CONTROL SYSTEM

Figure 17A:
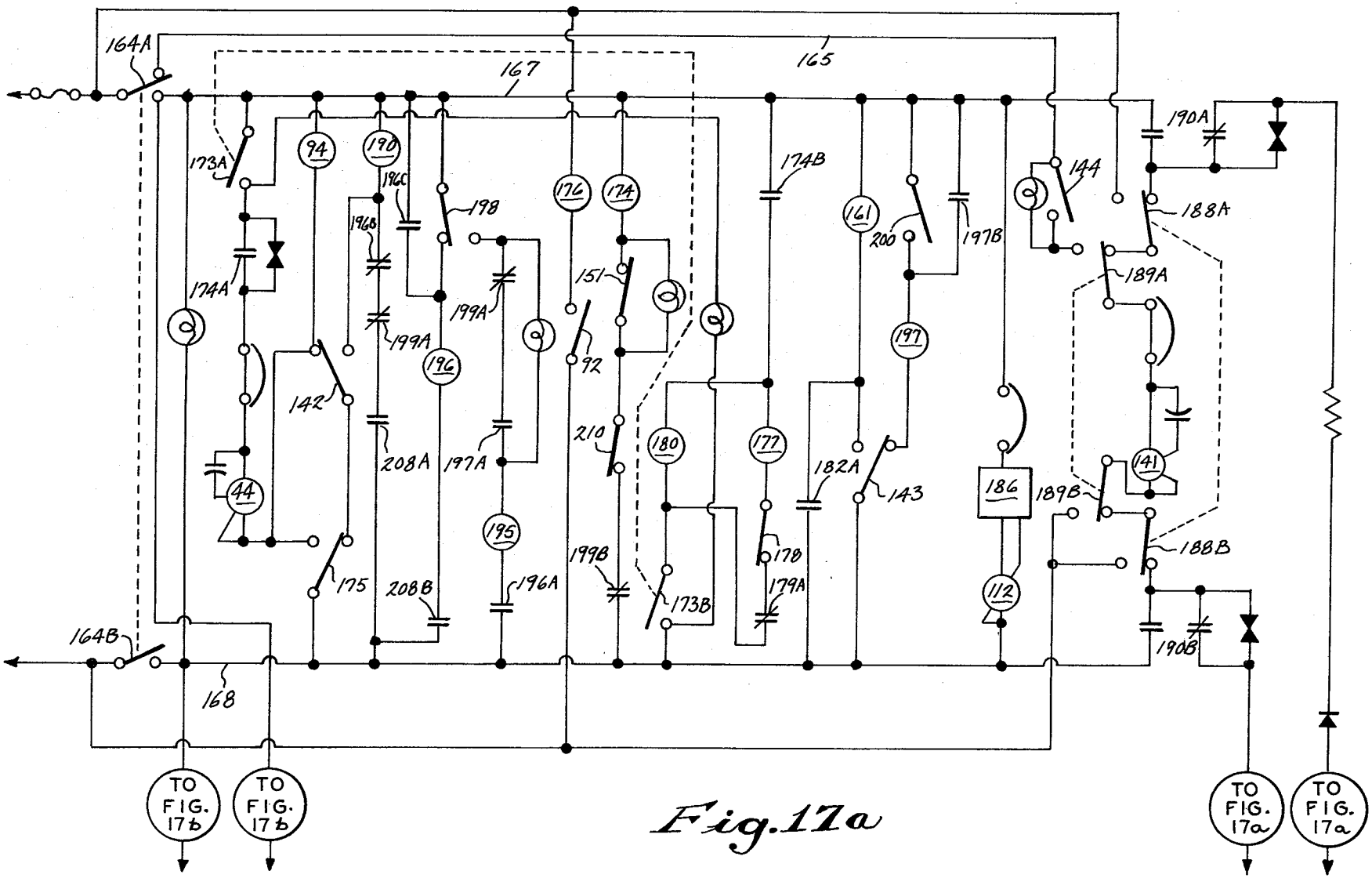
FIGS. 17A and 17B are schematic circuit diagrams of the control for the machine.
Figure 17B:
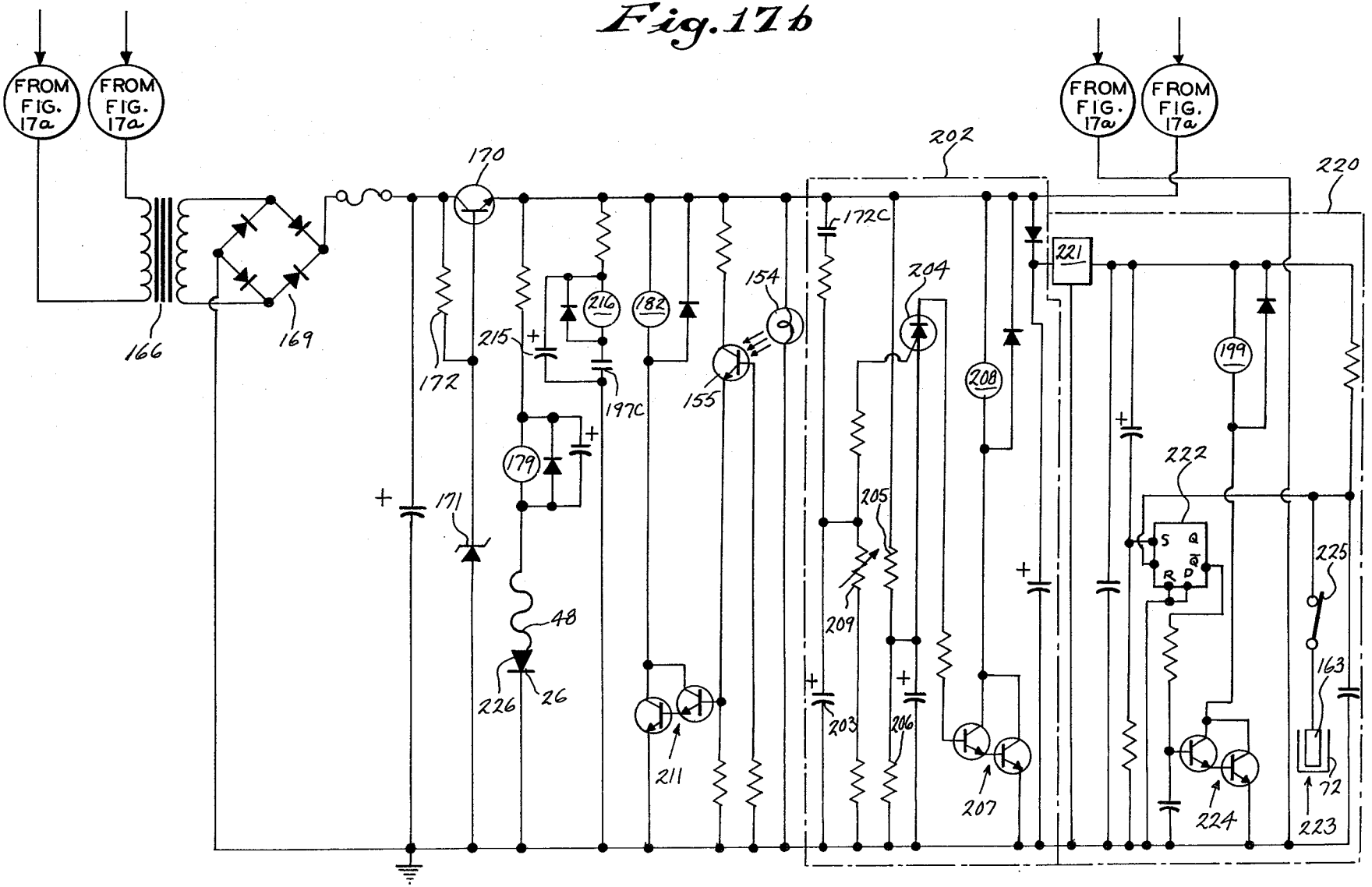

The electrical control system for the machine is shown in schematic form in FIGS. 17A and B. An a-c power source leads to one side of a pair of contacts 164A and 164B of a main power switch 164 located on the front control panel. The contact 164B is normally open and the contact 164A normally connects to a secondary power line 165 whose function is to provide power during a service or maintenance condition, as will be later explained. When the main power switch 164 is actuated, the a-c section of the control is energized. At the same time a d-c portion of the control is energized. The d-c portion is powered by a transformer 166 connected across the main power lines 167 and 168 and which connects to a bridge circuit 169 the output of which is controlled by a series regulator in the form of a power transistor 170, diode 171 and resistor 172. Thus, whenever the main power switch 164 is actuated, both the a-c and d-c portions of the control are energized.

The disc motor 44 for the count module 27 is connected to be energized upon the closing of one switch contact 173A of a coin feed switch 173 mounted on the control panel 20, and so long as the normally open relay contact 174A of a coin feed relay 174 has been closed upon energization of the coin feed relay 174. The circuit to actuate the disc motor 44 is then completed either through the homing switch 142 or by a bagging selector switch 175 whose function, as explained in greater detail hereafter, is to permit the machine to operate to empty all coins from the hopper and the count module without wrapping coins.

The motor 176 for driving the jog cam 90 is connected across the a-c power supply and is not controlled by the main power switch 160. The vibrating finger motor 176 is instead controlled solely by the normally open indexing switch 92 which rides the index cam 93. The indexing switch 92 is normally disabled from opening by the jog cam solenoid 94 which is connected in parallel with the disc motor 44 and is adapted to be deenergized to release the indexing switch 92 whenever the homing switch 142 is in a position indicating that a coin stack has been formed and wrapping of the coins is to proceed.

The hopper conveyor belt motor 177 is connected to be energized whenever: the normally opened contact 174B of the coin feed relay 174 is closed by energization of that relay, a manually actuatable hopper switch 178 remains closed, the relay contacts 179A of a coin level control relay 179 remain closed indicating that there is no excessive build-up of coins on the disc, and the coin feed switch contacts 173B are closed indicating that the coin feed switch has been actuated. When the circuit to energize the hopper conveyor motor 177 is completed, the circuit to energize the ejector solenoid 180 of the count module 27 will also be completed so that the ejector belt 29 will be lowered to engage coins in the discharge track of the count module and force them past the star wheel and out of the count module.

The paper feed motor 161 is connected to be energized either when the normally open contacts 182A of a paper feed relay 182 are closed or when the paper feed switch 143 controlled by a cam on the outboard portion of the cam shaft 140 is in a position calling for a paper feed. The paper feed relay 182 will be actuated, as will appear in greater detail hereafter, whenever the absence of the leading edge is sensed by the photocell 155.

The motor 112 for driving the wrapping roller 103, together with its motor starter relay 186 are connected across the power lines 167 and 168 so as to be energized at all times that the main power switch 164 is actuated.

The cam shaft drive motor 141 is connected to be energized by several different occurrences. First, if a normally actuatable jog switch 188 has its contacts 188A and 188B in the normal condition indicating that the jog switch has not been manually manipulated by an operator or serviceman, and further if the two contacts 189A and 189B of a service switch 189 are also in their normal position, a circuit to energize the cam shaft motor 141 can be completed whenever the relay contacts 190A and 190B of a cam drive relay 190 are closed by actuation of the relay 190 to connect the a-c side of the circuit to the cam shaft motor 141. When the cam drive relay 190 is deenergized, the relay contacts 190A and 190B connect the d-c portion of the circuit across the cam shaft motor 141 for the purpose of providing d-c braking on that motor and to thereby prevent coasting of the cam shaft 140.

The cam shaft drive motor 141 can also be energized by manually switching the jog switch 188 to close the contacts 188A and 188B across the a-c power source independent of the position of the power switch 164. This will allow a serviceman, for example, to rotate the cam shaft 140 by manually manipulating the jog switch 188. The cam shaft motor 141 can also be energized by the manual actuation of the service switch 189 to also complete a circuit to the a-c power source providing the main power switch 164 has not been actuated for wrapping and counting and so long as the service limit switch 144 controlled by the cam shaft 140 is closed. Referring to FIG. 16, the service limit switch 144 is closed except when the coin pad 75 is down, the wrapping roller 103 is out, the filler pad 118 is out, and the coin stool 85 is down. This is the service position and at that point a cam will open the service limit switch 144.

The start count solenoid 195 of the count module 27 is connected to be energized whenever the following conditions are present: the normally open contacts 196A of a start count relay 196 are closed by energization of that relay 196; the normally open contacts 197A of a cycle latch relay 197 are closed; the normally closed contacts 199A of a loose coin relay 199 are closed indicating that loose coins are not present in the discharge chute 72 of the machine; and the coin pad switch 198 is switched to a position indicating that the coin pad 75 is in place within the floor opening 70 and beneath the open bottom of the coin tube 52.

This completes the description of the circuitry for energizing the motors and solenoids. The circuitry for energizing the relays will now be described.

Figure 18:
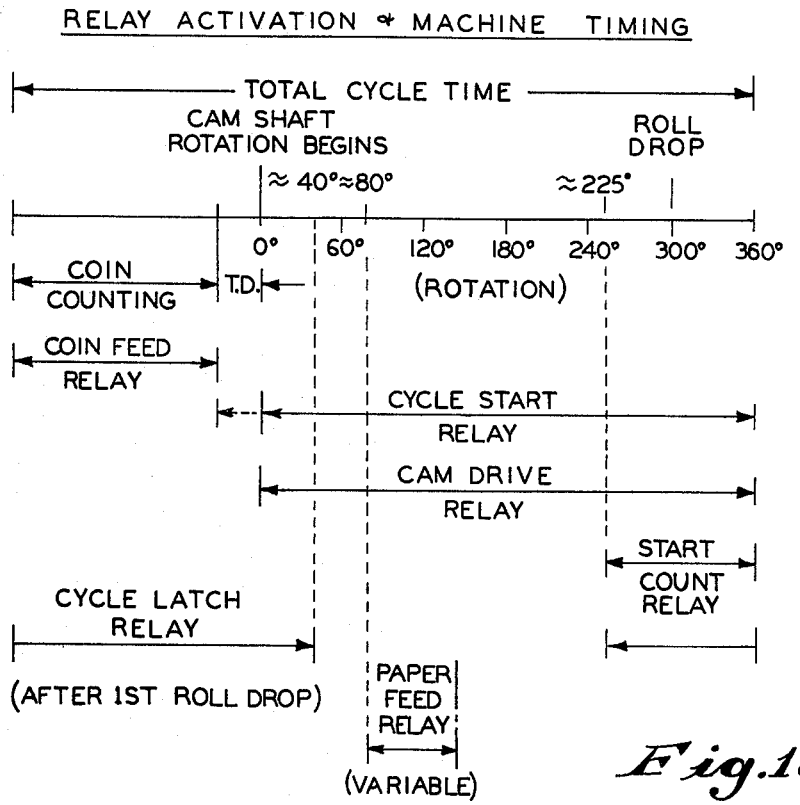
FIG. 18 is a schematic representation of the timing of various control relays forming a part of the control circuit.

The operation of the circuitry to control the energization of the relays may be better understood by reference to FIG. 18 which is a chart of the relay energization in relation to the total cycle time to complete one coin roll. The total cycle time includes one complete rotation of the cam shaft 140. Beginning with the drop of the previously formed coin roll which will swing the door 73 and momentarily close an exit switch 200 actuated by the door 73, the cycle latch relay 197 will be energized to close the relay contacts 197B to provide a hold-in circuit and will also close the relay contacts 197A in the circuit for the start count solenoid. The cycle latch relay 197 will remain energized so long as the paper feed switch is in a position which does not command the feeding of paper. When the cam shaft has completed its full rotation after the roll drop, the coin feed relay 174 will be energized if paper is present to maintain the paper sensing switch 151 closed. Energization of the coin feed relay 174 will close the relay contact 174A to energize the disc motor 44, will close the relay contact 174B to energize the hopper conveyor belt motor 177 and the ejector solenoid 180, and will close the relay contact 174C to thereby energize a settling time circuit, indicated generally by the reference numeral 202, and forming a part of the d-c circuit of the control.

When the coin feed relay contact 174C is closed in the settling time circuit 202, a capacitor 203 in said circuit will immediately be brought up to full charge and will be held charged so long as the contact 174C is maintained closed. When the contact is subsequently opened, the capacitor 203 will discharge and as soon as the potential at the gate of a programmable unijunction transistor 204 falls below the voltage established on the anode by a voltage dividing circuit consisting of resistors 205 and 206, the programmable unijunction transistor 204 will conduct thereby turning on the pair of transistors forming a Darlington circuit 207. This will energize the coil of the cycle start relay 208. In this manner the relay coil of the cycle start relay 208 is energized only after a time delay established by the time delay circuit 202 and determined by the time in which it takes to dissipate the charge on the capacitor 203 through the variable resistor 209 to a point where the unijunction transistor 204 will conduct.

Before this time delay occurs, and while the coin feed relay 174 remains energized, the count module will be counting out the predetermined number of coins. At the end of the count the predetermined count mechanism 27 will open an ejector switch 210 thereby opening the circuit to the coin feed relay 174. At this time the time delay circuit 202 functions.

Also during the time in which coins are being counted out of the count module and during the time delay established by the circuit 202, the jog lever solenoid 94 will be energized because the homing switch 142 will be in a position controlled by the zero position of the cam shaft 140. As a result, the jog lever motor 176 will continue to be energized and the coin stool 85 will be vibrated up and down to assist in the settling of the stack of coins fed out by the count mechanism.

The deenergization of the coin feed relay 174 will open the circuits to the disc motor 44 and to the hopper conveyor motor 177, as well as opening the contact 174C to begin the timing circuit 202. Thus, when the predetermined count is reached both the disc 26, the ejector belt 29, and the hopper conveyor 25 are stopped. Furthermore, the circuit is opened to deenergize the ejector solenoid 180 thereby allowing the ejector belt 29 to move up out of engagement with coins in the track.

Energization of the cycle start relay 208 at the completion of the time delay will close normally open relay contacts 208A thereby completing a circuit to energize the cam drive relay 190 to begin the rotation of the cam shaft 140 from its zero position. The energization of the cycle start relay 208 will also close normally open contacts 208B to provide a circuit for energization of the start count relay 196 when the pad switch 198 is switched to a position indicating that the coin pad 75 is retracted. Energizing the cam drive relay 190 will close the relay contacts 190A and 190B to connect the cam drive motor 141 to the a-c power supply to thereby cause the cam shaft 140 to begin its rotation. The cam shaft 140 will rotate thereby manipulating the coin pad, wrapper roller, filler pad, coin stool, and crimper mechanisms. After the cam shaft has rotated about 40°, the paper feed switch 143 will be actuated to its alternate position to energize the paper feed motor 161 and to deenergize the cycle latch relay 197. The paper will be driven by the paper feed roller 149 and carried into the coin tube until the paper feed switch 143 is again switched to its alternate position. If the leading edge of the paper is then in a position short of the photoelectric cell 155, the photoelectric cell 155 will conduct thereby driving another Darlington circuit 211 to cause the paper feed relay 182 to be energized. This will create an alternate circuit through the normally open relay contacts 182A to again energize the paper feed motor 161 and to thereby feed paper until the leading edge breaks the light beam from the light source 154 to cause the deenergization of the paper feed relay 182.

When the coin pad 75 has been moved to a position out of the way of the bottom of the wrapping tube, the coin pad switch 198 will switch to its alternate position to energize the start count relay 196. This will occur after the cam shaft 140 has rotated through about 255° and will cause the opening of the normally closed relay contact 196B which is in the circuit to energize the cam drive relay 190. The cam drive relay will remain energized, however, because of the position of the homing switch 142. Energizing the start count relay 196 will also close the normally open relay contacts 196C to provide a hold-in circuit for that relay. The energization of the start count relay 196 further closes the normally open contacts 196A to enable the circuit for the start count solenoid 195 as soon as the cycle latch relay 197 is energized to close its normally open contact 197A. This will happen when the exit switch 200 is closed as a roll moves the door 73. Thereafter, as soon as a coin pad 75 is back in place to actuate the coin pad switch 198 to its primary position, the start count solenoid 195 will receive a pulse which will cause it to mechanically trip the restart lever of the predetermined count mechanism 38 and allow for a subsequent dispensing of another stack of coins.

As a coin roll passes the exit point thereby closing the exit switch 200 to energize the cycle latch relay 197, a third relay contact 197C will be closed to allow a count capacitor 215, connected in parallel with a roll counter 216, to discharge to thereby trigger the electromechanical counter 216. The capacitor 215 acts as a timing filter to prevent every contact with the exit switch 200, no matter how extraneous, from actuating the roller counter 216 and insures that only one increment of counting will occur for every cycle of roll formation. An extraneous contact signal could be the result, for example, of an improperly wrapped roll in which loose coins would tumble when the roll was discharged with such coins having sufficient force to trigger the exit switch 200 more than once. The problem of loose coins from an improper wrap is also handled by means of a loose coin control circuit, which will now be described.

The loose coin control circuit is indicated generally by the reference number 220. The circuit is a part of the d-c control circuit and is stepped down in voltage by means of a regulator 221. The loose coin circuit 220 includes a wired D-type latching flip-flop 222 which is set whenever the main power switch 164 is actuated. The flip-flop 222 is clocked to change its state by the completion of a circuit through the loose coin switch 223 formed by the spill contact plate 163 and the discharge chute 72. When loose coins bridge the spill contact plate and the discharge chute, the loose coin switch 223 will be closed. Closing and opening of the loose coin switch 223 will cause the flip-flop 222 to change its state to turn on an additional Darlington circuit 224 thereby completing the circuit for energization of the loose coin relay 199.

Energization of the loose coin relay 199 will open the normally closed relay contacts 199A and 199B thereby preventing the completion of circuits for the cam drive relay 190 and the coin feed relay 174, respectively. Since those relays cannot be energized it will not be possible to continue the wrapping of rolls of coins. It is necessary for the operator to turn the main power switch 164 off and thereby determine the cause of the problem which resulted in loose coins in the exit. Only by turning off the main power switch 164 will the flip-flop 222 be reset upon the subsequent actuation of the main power switch 164. The resetting of the flip-flop 222 will remove the circuit for energizing the loose coin relay 199 and permit energization of the cam drive relay 190 and the coin feed relay 174 for subsequent operation of the machine. A manually actuatable spill contact disable switch 225 is connected in series with the loose coin switch 223 to disable that switch. This is necessary for certain service operations as well as for the bagging function to be described.

A level sensing switch 226 consists of the level control spring 48 and the disc 26 and is connected in the d-c portion of the circuit to control the energization of the level control relay 179. A timing filter network consisting of a capacitor and a resistor is connected in parallel with the level control relay 179 so that not every momentary closing of the level sensing switch 226 will result in energization of the relay coil. Only when the build-up of coins on the surface of the disc 26 is persistent so as to maintain the level sensing switch 226 closed for some period of time will the relay 179 be energized. When the coin level relay 179 is energized it opens the normally closed relay contacts 179A thereby preventing the energization of the hopper conveyor motor 177 to prevent the feed of any more coins onto the disc 26 until the coins present on the disc have been processed to the point where the level of coins on the disc 26 is back to normal.

MACHINE SET-UP

For initial setting up of the machine or when changing from one denomination to another, the first step in the procedure will be to manually actuate the service switch 189 located on the control panel of the machine. This will, as previously described, energize the cam shaft drive motor 141 until the cam shaft 140 has reached a position in which it will actuate the service limit switch 144. When the cam shaft has reached that position, the coin pad 75 will have been withdrawn, the wrapper roller 103 will be in an out position, the filler pad 118 will be in an out position, the coin stool 85 will have been withdrawn, and the crimper blades 125 and 126 will be open. This allows complete access to the wrapping area without interference from any of the active elements of the machine.

The machine will now have to be made ready for operation on a particular denomination of coin. This is accomplished by first adjusting the thickness gauge on the count module 27 by use of the lever 45 to match the proper coin, by adjusting the track on the count module 27 by use of the lever 46 to match the proper coin diameter, by setting the coin count on the count module to the correct quantity for a roll of that denomination, and by clearing the counting machine by manually rotating the star wheel shaft until it locks in place indicating that the predetermined count control mechanism is set. Manually tripping the reset handle 49 on the side of the count control mechanism will set it for its next operation. Then, the correct wrapping tube will be placed in the machine.

A paper roll for the particular denomination will also be required to be placed in the machine. The position of the paper blank length lever 158 is adjusted to match the length needed for the particular denomination of coin. The paper drive roller 149 is then held open by the lever 162 and the leading edge of the paper would be threaded into the guide track. Only a short distance of paper need be threaded since the machine will automatically index the paper to the correct spot when operation has begun. After the paper is threaded into the guide track the paper drive roller 162 is released.

The machine is now ready for normal use. Operation of the machine is started by actuating the coin feed switch 173 on the control panel 20.

BAGGING

The machine is also adapted to have a capability for bagging coins rather than forming them into rolls. This function can be used, for example, to automatically clear the coins which are in the hopper 24 and disc 26 of the machine thereby eliminating the need to physically remove the coins. This function can also be used to verify the count of coins in a lot of coins dumped into the hopper of the machine.

To set up the machine for a bagging operation, the service switch 189 is first manually actuated so that all of the elements of the machine not needed in bagging, such as the coin pad 75 and coin stool 85, are out of the way. The coin quantity selector would be moved to the position indicated by the designation "B" which has the effect of disengaging the predetermined count control mechanism 38. A bagging spout would be mounted at the discharge chute 72 and this spout can, if desired, contain an integral arm which, when the bagging spout is in place, trips the bagging selector switch 175. Alternatively, the bagging switch 175 may be arranged for manual actuation by the operator.

Actuating the bagging switch 175 will complete a circuit to energize the disc motor 44 as soon as the coin feed switch 173 on the control panel is actuated. Thus, the disc 26, the ejector belt 29, and the hopper conveyor 25 will be driven, and the coin feed relay 174 will be energized. However, the cam drive relay 190 will not be energized because of the position of the bagging switch 175. As a result, the cam shaft 140 will not be driven. Thus, coins will move from the hopper 24 across the disc 26 and out of the count module 27 through the coin tube 52 and into the bagging spout. During bagging, the manual switch 225 would be actuated to disable the loose coin detection switch 223.

If desired, a simplified coin tube can be employed for bagging operations in place of a standard coin tube. The bagging coin tube would be similar to the coin tube 52 except that its inside diameter can be such as to accommodate all denominations of coins and it would not be necessary to have the idler rollers or the vertical openings.

We claim:

1. A coin wrapping apparatus, comprising:

a stationary coin tube having a central bore sized for a particular denomination of coin and having an entrance extending along one side;

coin count means for ejecting a predetermined quantity of coins of such denomination into the central bore of said coin tube;

means for feeding paper to said coin tube;

a filler pad adapted to close said entrance while coins are being ejected into said coin tube;

a rotating wrapping roller adapted to have its periphery project through said entrance to engage said paper and wrap the same about the stack of coins in said tube; and means mounting said filler pad and wrapping roller for movement relative to said entrance so that one or the other of said filler pad and wrapping roller can be moved into place at said entrance.

2. A coin wrapping apparatus in accordance with claim 1, wherein said coin tube includes idler rollers mounted for rotation about axes parallel to the axis of said central bore and having their peripheries extending into said central bore.

3. A coin wrapped apparatus in accordance with claim 1, wherein said mounting means is movable between a withdrawn position in which said filler pad and wrapping roller are both away from said entrance, an intermediate position in which said filler plate can close said entrance, and a fully in position in which said wrapping roller projects through said entrance.

4. A coin wrapping apparatus in accordance with claim 3, wherein said filler pad is pivotally mounted about the axis of rotation of said wrapping roller and being normally urged to a position in which the filler pad is disposed between the entrance and said wrapping roller; and together with actuating means for pivoting said filler pad out of the way when said wrapping roller is to project through said entrance.

5. A coin wrapping apparatus in accordance with claim 3, together with upper and lower paper tube crimpers disposed on said mounting means and adapted to be actuated when said mounting means has been moved to said fully in position.

6. A coin wrapping apparatus, comprising:

a stationary, upright coin tube having a central bore sized for a particular denomination of coin and having a lengthwise entrance to said bore extending along one side;

coin count means for ejecting a predetermined quantity of coins of such denomination into the central bore of said coin tube;

means for feeding paper to said coin tube;

a wrapping roller assembly pivotally mounted relative to said coin tube;

a rotating elongated wrapping roller mounted on a vertical shaft on said assembly and spaced from the pivot of said assembly;

an elongated filler pad pivotally mounted on said shaft, said filler pad having an arcuate portion spaced from said wrapping roller and adapted to overlie said entrance;

and coordinated actuating means for pivoting said assembly from a withdrawn position to an intermediate position in which said filler pad overlies said entrance, and for pivoting said filler pad about said shaft and pivoting said assembly to a fully inward position in which the periphery of said wrapping roller extends into said entrance.

7. A coin wrapping apparatus in accordance with claim 6 wherein said coin tube is removably secured upon a floor plate with said central bore aligned with an opening in said plate;

said wrapping roller assembly is pivotally mounted on said floor plate; and coin stool means projecting through said opening from beneath said floor to engage the bottommost coin of a stack and to lift said stack within said central bore while paper is fed into said coin tube and said paper is wrapped about the stack of coins.

8. A coin wrapping apparatus in accordance with claim 7, together with upper and lower crimper blades slidably mounted for vertical movement on said assembly, said crimper blades projecting through said entrance above and below said wrapping roller when said assembly is in said fully inward position; and means for actuating said crimper blades to bring them together against the respective upper and lower ends of the paper tube formed about the coin stack.

9. A coin wrapping apparatus, comprising:

a floor plate having an opening therethrough;

a removable coin tube disposed on said floor plate and having a central bore aligned with said opening, said coin tube also having an entrance extending along one side;

coin count means for filling the central bore of said coin tube with a predetermined quantity of coins;

means for feeding paper to said coin tube;

a rotating wrapper roller mounted for movement relative to said entrance and adapted to project through said entrance to wrap said paper about the stack of coins in said tube;

a coin pad adapted to close said opening and the bottom of said central bore while said central bore is being filled; and a coin stool extending through said coin pad and engageable with the bottom coin in said stack and adapted to control the position of said stack within said central bore.

10. A coin wrapping apparatus in accordance with claim 9, together with means for vibrating said coin stool against the bottom coin as said central bore is filled with coins.

11. A coin wrapping apparatus in accordance with claim 10, together with means for retracting said coin pad and coin stool from said opening to allow a completed coin roll to drop from said coin tube through said opening.

12. A coin wrapping apparatus, comprising:

a floor plate having an opening therethrough;

a removable coin tube disposed on said floor plate and having a central bore aligned with said opening, said coin tube also having an entrance extending along one side;

coin count means for filling the central bore of said coin tube with a predetermined quantity of coins;

means for feeding paper to said coin tube;

a rotating wrapper roller mounted for movement relative to said entrance and adapted to project through said entrance to wrap said paper about the stack of coins in said tube;

a coin stool adapted to extend through said opening to engage the bottom coin in said stack; and positioning means for said coin stool adapted to move said coin stool between a retracted position in which the coin stool is withdrawn from said opening, an intermediate position in which the top of the coin stool is at the bottom of said central bore, and a raised position in which the coin stool lifts the stack of coins within said central bore.

13. A coin wrapping apparatus in accordance with claim 12, together with means for vibrating said coin stool up and down while said coin stool is in said intermediate position to settle coins into a compact stack.

14. A coin wrapping apparatus in accordance with claim 13, wherein said coin stool is an elongated rod;

said positioning means includes a pivotally mounted crank having one leg supporting the bottom of said coin stool; and said vibrating means includes a rotating cam having a portion which strikes a second leg of said crank as said lever rotates.

15. A coin wrapping apparatus, comprising:

a stationary coin tube having a central bore and an entrance to said central bore extending along one side;

coin count means for ejecting a predetermined quantity of coins of a particular denomination into the central bore of said coin tube;

a rotating wrapping roller adapted to have its periphery project through said entrance; and means for feeding paper to said entrance for engagement by said wrapping roller, said feeding means including a support for a roll of paper, a guide plate leading to said entrance, a feed roller engaging paper from said roll and moving the paper along said guide plate, a knife adjustably positioned to cut said paper after it has been engaged by said wrapping roller, said knife being adjusted to cut a length of paper required for said particular denomination, and means for advancing the resulting leading edge of said paper to a fixed point adjacent said coin tube after the cutting of said paper.

16. A coin wrapping apparatus in accordance with claim 15, together with a filler pad adapted to close said entrance while coins are being ejected into said coin tube;

means mounting said filler pad and wrapping roller for movement relative to said entrance so that one or the other of said filler pad and wrapping roller can be moved into place at said entrance;

a feed roller drive motor;

means for controlling said drive motor including first means coordinated with the actuation of said mounting means to energize said drive motor when said filler pad and wrapping roller are away from said entrance, and second means which senses the absence of paper at said fixed point to then energize said drive motor.

17. A coin wrapping apparatus in accordance with claim 16, wherein:

said second means includes a light source and a photoelectric cell disposed at said fixed point on opposite sides of the path of said paper along said guide plate.

18. A coin wrapping apparatus, comprising:

a floor plate having an opening therethrough;

a stationary coin tube having a central bore sized for a particular demonination of coin and aligned with said opening, said coin tube having an entrance to said central bore extending along one side;

coin count means for discharging a predetermined quantity of coins of such denomination seriatum into the central bore of said coin tube;

means for feeding paper to the entrance of said coin tube;

a filler pad adapted to close said entrance while coins are being discharged into said coin tube;

a rotating wrapping roller adapted to have its periphery project through said entrance to engage said paper and wrap the same about the stack of coins formed in said tube;

retractable means closing said opening during the stacking and wrapping of coins to form a completed roll;

detector means disposed beneath said floor plate and actuated by the discharge of a completed roll through said opening; and a control for said coin count means responsive to said detector means to enable said coin count means after said detector means has been actuated.

19. A coin wrapping apparatus in accordance with claim 18, together with an inclined discharge chute disposed beneath said opening; and wherein said detector means includes a swingable door normally closing said discharge chute and a switch actuated by the swinging of said door as a coin roll passes along said discharge chute.

20. A coin wrapping apparatus in accordance with claim 19, wherein said discharge chute has a floor including a plate electrically insulated from the remainder of the floor to define switch contacts which are bridged by loose coins passing along said discharge chute.

21. A coin wrapping apparatus in accordance with claim 20, wherein the switch defined by said floor and plate when closed disables said control for said coin count means.

* * * * *